US010221860B2

(12) United States Patent
Gammack et al.

(10) Patent No.: US 10,221,860 B2
(45) Date of Patent: Mar. 5, 2019

(54) FAN ASSEMBLY

(71) Applicant: Dyson Technology Limited, Wiltshire (GB)

(72) Inventors: Peter David Gammack, Swindon (GB); James Dyson, Bristol (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 412 days.

(21) Appl. No.: 14/819,160

(22) Filed: Aug. 5, 2015

(65) Prior Publication Data

US 2015/0354586 A1 Dec. 10, 2015

Related U.S. Application Data

(63) Continuation of application No. 12/716,740, filed on Mar. 3, 2010, now Pat. No. 9,127,689.

(30) Foreign Application Priority Data

Mar. 4, 2009 (GB) ..... 0903665.8

(51) Int. Cl.

| | |
|---|---|
| ***F04F 5/16*** | (2006.01) |
| ***F04D 25/08*** | (2006.01) |
| ***F04D 29/40*** | (2006.01) |
| ***F04D 29/62*** | (2006.01) |

(52) U.S. Cl.

CPC ..... *F04D 29/403* (2013.01); *F04D 25/08* (2013.01); *F04D 29/626* (2013.01); *F04F 5/16* (2013.01)

(58) Field of Classification Search

CPC ..... F04D 25/08; F04D 29/403; F04D 29/626; F04F 5/16

See application file for complete search history.

(56) References Cited

U.S. PATENT DOCUMENTS

| | | | |
|---|---|---|---|
| 284,962 | A | 9/1883 | Huston |
| 1,357,261 | A | 11/1920 | Svoboda |
| 1,767,060 | A | 6/1930 | Ferguson |
| 1,896,869 | A | 2/1933 | Larsh |

(Continued)

FOREIGN PATENT DOCUMENTS

| | | |
|---|---|---|
| AU | 2008323324 | 5/2009 |
| AU | 2011100923 | 9/2011 |

(Continued)

OTHER PUBLICATIONS

Search Report dated Jun. 5, 2009, directed to GB Application No. 0903665.8; 1 page.

(Continued)

*Primary Examiner* — Ninh H. Nguyen
*Assistant Examiner* — Brian P Wolcott
(74) *Attorney, Agent, or Firm* — Morrison & Foerster LLP

(57) ABSTRACT

A bladeless fan assembly for creating an air current includes a nozzle mounted on a base. The nozzle comprises an interior passage and a mouth for receiving the air flow from the interior passage and through which the air flow is emitted from the fan assembly. The nozzle defines an opening through which air from outside the fan assembly is drawn by the air flow emitted from the mouth. The nozzle is detachable from the base, which is preferably sized to be accommodated within the opening of the nozzle for transportation.

17 Claims, 11 Drawing Sheets

(56) References Cited

U.S. PATENT DOCUMENTS 2,014,185 A 9/1935 Martin
2,035,733 A 3/1936 Wall
2,071,266 A 2/1937 Schmidt
D103,476 S 3/1937 Weber
2,115,883 A 5/1938 Sher
D115,344 S 6/1939 Chapman
2,210,458 A 8/1940 Keilholtz
2,258,961 A 10/1941 Saathoff
2,295,502 A 9/1942 Lamb
2,336,295 A 12/1943 Reimuller
2,363,839 A 11/1944 Demuth
2,433,795 A 12/1947 Stokes
2,473,325 A 6/1949 Aufiero
2,476,002 A 7/1949 Stalker
2,488,467 A 11/1949 De Lisio
2,510,132 A 6/1950 Morrison
2,544,379 A 3/1951 Davenport
2,547,448 A 4/1951 Demuth
2,583,374 A 1/1952 Hoffman
2,620,127 A 12/1952 Radcliffe
2,711,682 A 6/1955 Drechsel
2,765,977 A 10/1956 Morrison
2,808,198 A 10/1957 Morrison
2,813,673 A 11/1957 Smith
2,830,779 A 4/1958 Wentling
2,838,229 A 6/1958 Belanger
2,922,277 A 1/1960 Bertin
2,922,570 A 1/1960 Allen
3,004,403 A 10/1961 Laporte
3,047,208 A 7/1962 Coanda
3,270,655 A 9/1966 Guirl et al.
D206,973 S 2/1967 De Lisio
3,444,817 A 5/1969 Caldwell
3,503,138 A 3/1970 Fuchs et al.
3,518,776 A 7/1970 Wolff et al.
3,724,092 A 4/1973 McCleerey
3,729,934 A 5/1973 Denning et al.
3,743,186 A 7/1973 Mocarski
3,795,367 A 3/1974 Mocarski
3,872,916 A 3/1975 Beck
3,875,745 A 4/1975 Franklin
3,885,891 A 5/1975 Throndson
3,943,329 A 3/1976 Hlavac
4,037,991 A 7/1977 Taylor
4,046,492 A 9/1977 Inglis
4,061,188 A 12/1977 Beck
4,073,613 A 2/1978 Desty
4,090,814 A 5/1978 Teodorescu et al.
4,113,416 A 9/1978 Kataoka et al.
4,136,735 A 1/1979 Beck et al.
4,173,995 A 11/1979 Beck
4,180,130 A 12/1979 Beck et al.
4,184,417 A 1/1980 Chancellor
4,184,541 A 1/1980 Beck et al.
4,192,461 A 3/1980 Arborg
4,332,529 A 6/1982 Alperin
4,336,017 A 6/1982 Desty
4,342,204 A 8/1982 Melikian et al.
4,448,354 A 5/1984 Reznick et al.
4,483,503 A 11/1984 Gahan
4,502,837 A 3/1985 Blair et al.
4,533,105 A 8/1985 Cornwall, Jr. et al.
4,568,243 A 2/1986 Schubert et al.
4,575,033 A 3/1986 Henneberg et al.
4,621,782 A 11/1986 Carlson et al.
4,630,475 A 12/1986 Mizoguchi
4,643,351 A 2/1987 Fukamachi et al.
D288,876 S 3/1987 Goetz et al.
4,703,152 A 10/1987 Shih-Chin
4,718,870 A 1/1988 Watts
4,732,539 A 3/1988 Shin-Chin
4,734,017 A 3/1988 Levin
4,790,133 A 12/1988 Stuart
4,850,804 A 7/1989 Huang
4,878,620 A 11/1989 Tarleton
4,893,990 A 1/1990 Tomohiro et al.
4,978,281 A 12/1990 Conger
5,061,405 A 10/1991 Stanek et al.
D325,435 S 4/1992 Coup et al.
5,110,266 A 5/1992 Toyoshima et al.
5,168,722 A 12/1992 Brock
5,176,856 A 1/1993 Takahashi et al.
5,188,508 A 2/1993 Scott et al.
5,296,769 A 3/1994 Havens et al.
5,310,313 A 5/1994 Chen
5,317,815 A 6/1994 Hwang
5,395,087 A 3/1995 VanBasten
5,402,938 A 4/1995 Sweeney
5,407,324 A 4/1995 Starnes, Jr. et al.
5,425,902 A 6/1995 Miller et al.
5,435,489 A 7/1995 Jenkins et al.
5,518,216 A 5/1996 Wu
5,518,370 A 5/1996 Wang et al.
5,609,473 A 3/1997 Litvin
5,645,769 A 7/1997 Tamaru et al.
5,649,370 A 7/1997 Russo
5,671,321 A 9/1997 Bagnuolo
5,720,594 A 2/1998 Snow
5,730,582 A 3/1998 Heitmann
5,735,683 A 4/1998 Muschelknautz
5,762,034 A 6/1998 Foss
5,762,661 A 6/1998 Kleinberger et al.
5,783,117 A 7/1998 Byassee et al.
5,794,306 A 8/1998 Firdaus
D398,983 S 9/1998 Keller et al.
5,841,080 A 11/1998 Iida et al.
5,843,344 A 12/1998 Junket et al.
5,862,037 A 1/1999 Behl
5,868,197 A 2/1999 Potier
5,881,685 A 3/1999 Foss et al.
D415,271 S 10/1999 Feer
6,015,274 A 1/2000 Bias et al.
6,065,936 A 5/2000 Shingai et al.
6,073,881 A 6/2000 Chen
6,082,969 A 7/2000 Carroll et al.
D429,808 S 8/2000 Krauss et al.
6,123,618 A 9/2000 Day
6,155,782 A 12/2000 Hsu
D435,899 S 1/2001 Melwani
6,227,518 B1 5/2001 Sun
6,244,823 B1 6/2001 Marino et al.
6,254,337 B1 7/2001 Arnold
6,269,549 B1 8/2001 Carlucci et al.
6,278,248 B1 8/2001 Hong et al.
6,282,746 B1 9/2001 Schleeter
6,293,121 B1 9/2001 Labrador
6,321,034 B2 11/2001 Jones-Lawlor et al.
6,338,610 B1 1/2002 Harada et al.
6,348,106 B1 2/2002 Embree et al.
6,386,845 B1 5/2002 Bedard
6,454,527 B2 9/2002 Nishiyama et al.
6,480,672 B1 11/2002 Rosenzweig et al.
6,511,288 B1 1/2003 Gatley, Jr.
6,599,088 B2 7/2003 Stagg
6,604,694 B1 8/2003 Kordas et al.
D485,895 S 1/2004 Melwani
6,709,236 B1 3/2004 Hoelzer
6,789,787 B2 9/2004 Stutts
6,791,056 B2 9/2004 VanOtteren et al.
6,830,433 B2 12/2004 Birdsell et al.
6,932,579 B2 8/2005 Cichetti, Sr. et al.
7,059,826 B2 6/2006 Lasko
7,088,913 B1 8/2006 Verhoorn et al.
7,147,336 B1 12/2006 Chou
7,158,716 B2 * 1/2007 Shapiro ..... F04D 17/04
392/365
D539,414 S 3/2007 Russak et al.
7,186,075 B2 3/2007 Winkler et al.
7,189,053 B2 3/2007 Winkler et al.
7,192,258 B2 3/2007 Kuo et al.
7,198,473 B2 4/2007 Stickland et al.
7,317,267 B2 1/2008 Schmid et al.
7,412,781 B2 8/2008 Mattinger et al.
7,455,504 B2 11/2008 Hill et al.

(56) References Cited

U.S. PATENT DOCUMENTS

| | | | |
|---|---|---|---|
| 7,466,820 | B2 | 12/2008 | Lee |
| 7,478,993 | B2 | 1/2009 | Hong et al. |
| 7,540,474 | B1 | 6/2009 | Huang et al. |
| D598,532 | S | 8/2009 | Dyson et al. |
| D602,143 | S | 10/2009 | Gammack et al. |
| D602,144 | S | 10/2009 | Dyson et al. |
| D605,748 | S | 12/2009 | Gammack et al. |
| 7,660,110 | B2 | 2/2010 | Vinson et al. |
| 7,664,377 | B2 | 2/2010 | Liao |
| D614,280 | S | 4/2010 | Dyson et al. |
| 7,731,050 | B2 | 6/2010 | Parks et al. |
| 7,775,848 | B1 | 8/2010 | Auerbach |
| 7,806,388 | B2 | 10/2010 | Junkel et al. |
| 7,841,045 | B2 | 11/2010 | Shaanan et al. |
| 7,921,962 | B2 | 4/2011 | Liddell |
| 8,002,520 | B2 | 8/2011 | Dawson et al. |
| 8,092,166 | B2 | 1/2012 | Nicolas et al. |
| 8,113,490 | B2 | 2/2012 | Chen |
| 8,152,495 | B2 | 4/2012 | Boggess, Jr. et al. |
| 8,246,317 | B2 | 8/2012 | Gammack |
| 8,308,445 | B2 | 11/2012 | Gammack et al. |
| 8,348,629 | B2 | 1/2013 | Fitton et al. |
| 8,356,804 | B2 | 1/2013 | Fitton et al. |
| 8,430,624 | B2 | 4/2013 | Cookson et al. |
| 8,454,322 | B2 | 6/2013 | Gammack et al. |
| 8,469,658 | B2 | 6/2013 | Gammack et al. |
| 8,529,226 | B2 | 9/2013 | Li |
| 8,544,826 | B2 | 10/2013 | Ediger et al. |
| 8,721,307 | B2 | 5/2014 | Li |
| 2002/0106547 | A1 | 8/2002 | Sugawara et al. |
| 2003/0059307 | A1 | 3/2003 | Moreno et al. |
| 2003/0164367 | A1 | 9/2003 | Bucher et al. |
| 2003/0171093 | A1 | 9/2003 | Gumucio Del Pozo |
| 2003/0190183 | A1 | 10/2003 | Hsing |
| 2004/0022631 | A1 | 2/2004 | Birdsell et al. |
| 2004/0049842 | A1 | 3/2004 | Prehodka |
| 2004/0106370 | A1 | 6/2004 | Honda et al. |
| 2004/0149881 | A1 | 8/2004 | Allen |
| 2005/0031448 | A1 | 2/2005 | Lasko et al. |
| 2005/0053465 | A1 | 3/2005 | Roach et al. |
| 2005/0069407 | A1 | 3/2005 | Winkler et al. |
| 2005/0128698 | A1 | 6/2005 | Huang |
| 2005/0163670 | A1 | 7/2005 | Alleyne et al. |
| 2005/0173997 | A1 | 8/2005 | Schmid et al. |
| 2005/0276684 | A1 | 12/2005 | Huang et al. |
| 2005/0281672 | A1 | 12/2005 | Parker et al. |
| 2006/0172682 | A1 | 8/2006 | Orr et al. |
| 2006/0199515 | A1 | 9/2006 | Lasko et al. |
| 2006/0263073 | A1 | 11/2006 | Clarke et al. |
| 2006/0279927 | A1 | 12/2006 | Strohm |
| 2007/0035189 | A1 | 2/2007 | Matsumoto |
| 2007/0041857 | A1 | 2/2007 | Fleig |
| 2007/0048159 | A1 | 3/2007 | DiMatteo et al. |
| 2007/0065280 | A1 | 3/2007 | Fok |
| 2007/0166160 | A1 | 7/2007 | Russak et al. |
| 2007/0176502 | A1 | 8/2007 | Kasai et al. |
| 2007/0224044 | A1 | 9/2007 | Hong et al. |
| 2007/0269323 | A1 | 11/2007 | Zhou et al. |
| 2008/0020698 | A1 | 1/2008 | Spaggiari |
| 2008/0124060 | A1 | 5/2008 | Gao |
| 2008/0152482 | A1 | 6/2008 | Patel |
| 2008/0166224 | A1 | 7/2008 | Giffin |
| 2008/0286130 | A1 | 11/2008 | Purvines |
| 2008/0304986 | A1 | 12/2008 | Kenyon et al. |
| 2008/0314250 | A1 | 12/2008 | Cowie et al. |
| 2009/0026850 | A1 | 1/2009 | Fu |
| 2009/0032130 | A1 | 2/2009 | Dumas et al. |
| 2009/0039805 | A1 | 2/2009 | Tang |
| 2009/0060710 | A1 | 3/2009 | Gammack et al. |
| 2009/0060711 | A1 | 3/2009 | Gammack et al. |
| 2009/0078120 | A1 | 3/2009 | Kummer et al. |
| 2009/0120925 | A1 | 5/2009 | Lasko |
| 2009/0191054 | A1 | 7/2009 | Winkler |
| 2009/0214341 | A1 | 8/2009 | Craig |
| 2010/0133707 | A1 | 6/2010 | Huang |
| 2010/0150699 | A1 | 6/2010 | Nicolas et al. |
| 2010/0162011 | A1 | 6/2010 | Min |
| 2010/0171465 | A1 | 7/2010 | Seal et al. |
| 2010/0225012 | A1 | 9/2010 | Fitton et al. |
| 2010/0226749 | A1 | 9/2010 | Gammack et al. |
| 2010/0226750 | A1 | 9/2010 | Gammack |
| 2010/0226751 | A1 | 9/2010 | Gammack et al. |
| 2010/0226752 | A1 | 9/2010 | Gammack et al. |
| 2010/0226753 | A1 | 9/2010 | Dyson et al. |
| 2010/0226754 | A1 | 9/2010 | Hutton et al. |
| 2010/0226758 | A1 | 9/2010 | Cookson et al. |
| 2010/0226764 | A1 | 9/2010 | Gammack et al. |
| 2010/0226769 | A1 | 9/2010 | Helps |
| 2010/0226771 | A1 | 9/2010 | Crawford et al. |
| 2010/0226787 | A1 | 9/2010 | Gammack et al. |
| 2010/0226797 | A1 | 9/2010 | Fitton et al. |
| 2010/0226801 | A1 | 9/2010 | Gammack |
| 2010/0254800 | A1 | 10/2010 | Fitton et al. |
| 2011/0002775 | A1 | 1/2011 | Ma et al. |
| 2011/0058935 | A1 | 3/2011 | Gammack et al. |
| 2011/0110805 | A1 | 5/2011 | Gammack et al. |
| 2011/0164959 | A1 | 7/2011 | Fitton et al. |
| 2011/0223014 | A1 | 9/2011 | Crawford et al. |
| 2011/0223015 | A1 | 9/2011 | Gammack et al. |
| 2012/0031509 | A1 | 2/2012 | Wallace et al. |
| 2012/0033952 | A1 | 2/2012 | Wallace et al. |
| 2012/0034108 | A1 | 2/2012 | Wallace et al. |
| 2012/0039705 | A1 | 2/2012 | Gammack |
| 2012/0045315 | A1 | 2/2012 | Gammack |
| 2012/0045316 | A1 | 2/2012 | Gammack |
| 2012/0057959 | A1 | 3/2012 | Hodgson et al. |
| 2012/0082561 | A1 | 4/2012 | Gammack et al. |
| 2012/0093629 | A1 | 4/2012 | Fitton et al. |
| 2012/0093630 | A1 | 4/2012 | Fitton et al. |
| 2012/0114513 | A1 | 5/2012 | Simmonds et al. |
| 2012/0230658 | A1 | 9/2012 | Fitton et al. |
| 2012/0308375 | A1 | 12/2012 | Gammack |
| 2013/0011252 | A1 | 1/2013 | Crawford et al. |
| 2013/0026664 | A1 | 1/2013 | Staniforth et al. |
| 2013/0028763 | A1 | 1/2013 | Staniforth et al. |
| 2013/0028766 | A1 | 1/2013 | Staniforth et al. |
| 2013/0045084 | A1 | 2/2013 | Tu et al. |
| 2013/0129490 | A1 | 5/2013 | Dos Reis et al. |
| 2013/0161842 | A1 | 6/2013 | Fitton et al. |
| 2013/0189083 | A1 | 7/2013 | Atkinson |
| 2013/0199372 | A1 | 8/2013 | Nock et al. |
| 2013/0272858 | A1 | 10/2013 | Stickney et al. |
| 2013/0280051 | A1 | 10/2013 | Nicolas et al. |
| 2013/0280061 | A1 | 10/2013 | Stickney |
| 2013/0280096 | A1 | 10/2013 | Gammack et al. |
| 2013/0302156 | A1 | 11/2013 | Nurzynski |
| 2013/0309065 | A1 | 11/2013 | Johnson et al. |
| 2013/0309066 | A1 | 11/2013 | Atkinson et al. |
| 2013/0309080 | A1 | 11/2013 | Johnson et al. |
| 2013/0323025 | A1 | 12/2013 | Crawford et al. |
| 2013/0323100 | A1 | 12/2013 | Poulton et al. |
| 2013/0330215 | A1 | 12/2013 | Li |
| 2014/0017069 | A1 | 1/2014 | Peters |
| 2014/0077398 | A1 | 3/2014 | Staniforth et al. |
| 2014/0079566 | A1 | 3/2014 | Gammack et al. |
| 2014/0084492 | A1 | 3/2014 | Staniforth et al. |
| 2014/0210114 | A1 | 7/2014 | Staniforth et al. |
| 2014/0255173 | A1 | 9/2014 | Poulton et al. |
| 2014/0255217 | A1 | 9/2014 | Li |
| 2018/0274815 | A1 | 9/2018 | Gammack et al. |

FOREIGN PATENT DOCUMENTS

| | | |
|---|---|---|
| BE | 560119 | 8/1957 |
| CA | 1055344 | 5/1979 |
| CA | 2155482 | 9/1996 |
| CH | 346643 | 5/1960 |
| CN | 87 2 02488 | 3/1988 |
| CN | 2085866 | 10/1991 |
| CN | 2111392 | 7/1992 |
| CN | 2228996 | 6/1996 |
| CN | 1232143 | 10/1999 |
| CN | 1288506 | 3/2001 |
| CN | 1336482 | 2/2002 |

(56) References Cited

FOREIGN PATENT DOCUMENTS

| | | |
|---|---|---|
| CN | 1437300 | 8/2003 |
| CN | 2650005 | 10/2004 |
| CN | 2713643 | 7/2005 |
| CN | 1680727 | 10/2005 |
| CN | 2806846 | 8/2006 |
| CN | 2833197 | 11/2006 |
| CN | 101046318 | 10/2007 |
| CN | 200966872 | 10/2007 |
| CN | 201011346 | 1/2008 |
| CN | 201180678 | 1/2009 |
| CN | 201221477 | 4/2009 |
| CN | 101424279 | 5/2009 |
| CN | 101451754 | 6/2009 |
| CN | 201281416 | 7/2009 |
| CN | 101560988 | 10/2009 |
| CN | 201349269 | 11/2009 |
| CN | 101684828 | 3/2010 |
| CN | 201486901 | 5/2010 |
| CN | 101749288 | 6/2010 |
| CN | 201502549 | 6/2010 |
| CN | 201507461 | 6/2010 |
| CN | 101816534 | 9/2010 |
| CN | 101825095 | 9/2010 |
| CN | 101825096 | 9/2010 |
| CN | 101825101 | 9/2010 |
| CN | 101825102 | 9/2010 |
| CN | 101825103 | 9/2010 |
| CN | 101825104 | 9/2010 |
| CN | 201568337 | 9/2010 |
| CN | 101858355 | 10/2010 |
| CN | 101936310 | 1/2011 |
| CN | 201696365 | 1/2011 |
| CN | 201696366 | 1/2011 |
| CN | 201739199 | 2/2011 |
| CN | 101984299 | 3/2011 |
| CN | 101985948 | 3/2011 |
| CN | 201763705 | 3/2011 |
| CN | 201763706 | 3/2011 |
| CN | 201770513 | 3/2011 |
| CN | 201771875 | 3/2011 |
| CN | 201779080 | 3/2011 |
| CN | 201786777 | 4/2011 |
| CN | 201786778 | 4/2011 |
| CN | 201802648 | 4/2011 |
| CN | 102095236 | 6/2011 |
| CN | 201858204 | 6/2011 |
| CN | 201874898 | 6/2011 |
| CN | 201874901 | 6/2011 |
| CN | 201917047 | 8/2011 |
| CN | 102251973 | 11/2011 |
| CN | 102287357 | 12/2011 |
| CN | 102305220 | 1/2012 |
| CN | 102367813 | 3/2012 |
| CN | 202165330 | 3/2012 |
| CN | 202267207 | 6/2012 |
| CN | 202431623 | 9/2012 |
| DE | 1 291 090 | 3/1969 |
| DE | 24 51 557 | 5/1976 |
| DE | 27 48 724 | 5/1978 |
| DE | 3644567 | 7/1988 |
| DE | 41 27 134 | 2/1993 |
| DE | 195 10 397 | 9/1996 |
| DE | 197 12 228 | 10/1998 |
| DE | 100 00 400 | 3/2001 |
| DE | 10041805 | 6/2002 |
| DE | 10 2009 007 037 | 8/2010 |
| DE | 10 2009 044 349 | 5/2011 |
| EP | 0 044 494 | 1/1982 |
| EP | 0 186 581 | 7/1986 |
| EP | 0 784 947 | 7/1997 |
| EP | 0 955 469 | 11/1999 |
| EP | 1 094 224 | 4/2001 |
| EP | 1 138 954 | 10/2001 |
| EP | 1357296 | 10/2003 |
| EP | 1 566 548 | 8/2005 |
| EP | 1 779 745 | 5/2007 |
| EP | 1 939 456 | 7/2008 |
| EP | 1 980 432 | 10/2008 |
| EP | 2 000 675 | 12/2008 |
| EP | 2191142 | 6/2010 |
| EP | 2 578 889 | 4/2013 |
| FR | 1033034 | 7/1953 |
| FR | 1119439 | 6/1956 |
| FR | 1.387.334 | 1/1965 |
| FR | 2 375 471 | 7/1978 |
| FR | 2 534 983 | 4/1984 |
| FR | 2 640 857 | 6/1990 |
| FR | 2 658 593 | 8/1991 |
| FR | 2794195 | 12/2000 |
| FR | 2 874 409 | 2/2006 |
| FR | 2 906 980 | 4/2008 |
| FR | 2928706 | 9/2009 |
| GB | 22235 | 6/1914 |
| GB | 383498 | 11/1932 |
| GB | 593828 | 10/1947 |
| GB | 601222 | 4/1948 |
| GB | 633273 | 12/1949 |
| GB | 641622 | 8/1950 |
| GB | 661747 | 11/1951 |
| GB | 863 124 | 3/1961 |
| GB | 1067956 | 5/1967 |
| GB | 1 262 131 | 2/1972 |
| GB | 1 265 341 | 3/1972 |
| GB | 1 278 606 | 6/1972 |
| GB | 1 304 560 | 1/1973 |
| GB | 1 403 188 | 8/1975 |
| GB | 1 434 226 | 5/1976 |
| GB | 1 501 473 | 2/1978 |
| GB | 2 094 400 | 9/1982 |
| GB | 2 107 787 | 5/1983 |
| GB | 2 111 125 | 6/1983 |
| GB | 2 178 256 | 2/1987 |
| GB | 2 185 531 | 7/1987 |
| GB | 2 185 533 | 7/1987 |
| GB | 2 218 196 | 11/1989 |
| GB | 2 236 804 | 4/1991 |
| GB | 2 237 323 | 5/1991 |
| GB | 2 240 268 | 7/1991 |
| GB | 2 242 935 | 10/1991 |
| GB | 2 285 504 | 7/1995 |
| GB | 2 289 087 | 11/1995 |
| GB | 2383277 | 6/2003 |
| GB | 2 428 569 | 2/2007 |
| GB | 2 452 593 | 3/2009 |
| GB | 2452490 | 3/2009 |
| GB | 2463698 | 3/2010 |
| GB | 2464736 | 4/2010 |
| GB | 2466058 | 6/2010 |
| GB | 2468312 | 9/2010 |
| GB | 2468313 | 9/2010 |
| GB | 2468315 | 9/2010 |
| GB | 2468317 | 9/2010 |
| GB | 2468319 | 9/2010 |
| GB | 2468320 | 9/2010 |
| GB | 2468323 | 9/2010 |
| GB | 2468328 | 9/2010 |
| GB | 2468331 | 9/2010 |
| GB | 2468369 | 9/2010 |
| GB | 2468498 | 9/2010 |
| GB | 2473037 | 3/2011 |
| GB | 2479760 | 10/2011 |
| GB | 2482547 | 2/2012 |
| GB | 2484671 | 4/2012 |
| GB | 2484695 | 4/2012 |
| GB | 2484761 | 4/2012 |
| GB | 2493231 | 1/2013 |
| GB | 2493505 | 2/2013 |
| GB | 2493507 | 2/2013 |
| GB | 2500011 | 9/2013 |
| JP | 31-13055 | 8/1956 |
| JP | 35-4369 | 3/1960 |
| JP | 39-7297 | 3/1964 |
| JP | 46-7230 | 12/1971 |
| JP | 49-150403 | 12/1974 |

(56) References Cited

FOREIGN PATENT DOCUMENTS

| | | |
|---|---|---|
| JP | 51-7258 | 1/1976 |
| JP | 53-1015 | 1/1978 |
| JP | 53-51608 | 5/1978 |
| JP | 53-60100 | 5/1978 |
| JP | 56-167897 | 12/1981 |
| JP | 56167897 A * | 12/1981 |
| JP | 57-71000 | 5/1982 |
| JP | 57-157097 | 9/1982 |
| JP | 59-90797 | 5/1984 |
| JP | 59-167984 | 11/1984 |
| JP | 60-105896 | 7/1985 |
| JP | 61-31830 | 2/1986 |
| JP | 61-116093 | 6/1986 |
| JP | 61-218824 | 9/1986 |
| JP | 61-280787 | 12/1986 |
| JP | 62-223494 | 10/1987 |
| JP | 63-36794 | 3/1988 |
| JP | 63-50174 | 3/1988 |
| JP | 63-179198 | 7/1988 |
| JP | 63-306340 | 12/1988 |
| JP | 64-7273 | 2/1989 |
| JP | 64-21300 | 2/1989 |
| JP | 64-58955 | 3/1989 |
| JP | 64-83884 | 3/1989 |
| JP | 1-138399 | 5/1989 |
| JP | 1-224598 | 9/1989 |
| JP | 2-146294 | 6/1990 |
| JP | 2-218890 | 8/1990 |
| JP | 2-248690 | 10/1990 |
| JP | 3-3419 | 1/1991 |
| JP | 3-52515 | 5/1991 |
| JP | 3-267598 | 11/1991 |
| JP | 3-286775 | 12/1991 |
| JP | 4-43895 | 2/1992 |
| JP | 4-366330 | 12/1992 |
| JP | 5-157093 | 6/1993 |
| JP | 5-164089 | 6/1993 |
| JP | 5-263786 | 10/1993 |
| JP | 6-74190 | 3/1994 |
| JP | 6-86898 | 3/1994 |
| JP | 6-147188 | 5/1994 |
| JP | 6-257591 | 9/1994 |
| JP | 6-280800 | 10/1994 |
| JP | 6-336113 | 12/1994 |
| JP | 7-190443 | 7/1995 |
| JP | 7-247991 | 9/1995 |
| JP | 8-21400 | 1/1996 |
| JP | 8-72525 | 3/1996 |
| JP | 9-100800 | 4/1997 |
| JP | 9-178083 | 7/1997 |
| JP | 9-233407 | 9/1997 |
| JP | 9-287600 | 11/1997 |
| JP | 10-65999 | 3/1998 |
| JP | 10-122188 | 5/1998 |
| JP | 11-502586 | 3/1999 |
| JP | 11-227866 | 8/1999 |
| JP | 2000-116179 | 4/2000 |
| JP | 2000-201723 | 7/2000 |
| JP | 2001-17358 | 1/2001 |
| JP | 2001-295785 | 10/2001 |
| JP | 2002-21797 | 1/2002 |
| JP | 2002-138829 | 5/2002 |
| JP | 2002-188593 | 7/2002 |
| JP | 2002-213388 | 7/2002 |
| JP | 2003-274070 | 9/2003 |
| JP | 2003-329273 | 11/2003 |
| JP | 2004-8275 | 1/2004 |
| JP | 2004-208935 | 7/2004 |
| JP | 2004-216221 | 8/2004 |
| JP | 2005-201507 | 7/2005 |
| JP | 2005-307985 | 11/2005 |
| JP | 2006-89096 | 4/2006 |
| JP | 3127331 | 11/2006 |
| JP | 2007-138763 | 6/2007 |
| JP | 2007-138789 | 6/2007 |
| JP | 2008-39316 | 2/2008 |
| JP | 2008-100204 | 5/2008 |
| JP | 3146538 | 10/2008 |
| JP | 2008-294243 | 12/2008 |
| JP | 2009-44568 | 2/2009 |
| JP | 2009-62986 | 3/2009 |
| JP | 2009-264121 | 11/2009 |
| JP | 2010-131259 | 6/2010 |
| JP | 2010-203443 | 9/2010 |
| JP | 2010-203446 | 9/2010 |
| JP | 2010-203764 | 9/2010 |
| JP | 2012-31806 | 2/2012 |
| JP | 2012-36897 | 2/2012 |
| JP | 2012-57619 | 3/2012 |
| KR | 90-5812 | 8/1990 |
| KR | 1999-002660 | 1/1999 |
| KR | 2002-0061691 | 7/2002 |
| KR | 2002-0067468 | 8/2002 |
| KR | 10-2005-0102317 | 10/2005 |
| KR | 10-0576107 | 4/2006 |
| KR | 10-2007-0007997 | 1/2007 |
| KR | 20-0448319 | 3/2010 |
| KR | 10-2010-0055611 | 5/2010 |
| KR | 2000-0032363 | 6/2010 |
| KR | 10-0985378 | 9/2010 |
| TW | 517825 | 1/2003 |
| TW | 589932 | 6/2004 |
| TW | M394383 | 12/2010 |
| TW | M399207 | 3/2011 |
| TW | M407299 | 7/2011 |
| WO | WO-90/13478 | 11/1990 |
| WO | WO-95/06822 | 3/1995 |
| WO | WO-02/073096 | 9/2002 |
| WO | WO-03/058795 | 7/2003 |
| WO | WO-03/069931 | 8/2003 |
| WO | WO-2005/050026 | 6/2005 |
| WO | WO-2005/057091 | 6/2005 |
| WO | WO-2006/008021 | 1/2006 |
| WO | WO-2006/012526 | 2/2006 |
| WO | WO-2007/024955 | 3/2007 |
| WO | WO-2007/048205 | 5/2007 |
| WO | WO-2008/014641 | 2/2008 |
| WO | WO-2008/024569 | 2/2008 |
| WO | WO-2008/139491 | 11/2008 |
| WO | WO-2009/030879 | 3/2009 |
| WO | WO-2009/030881 | 3/2009 |
| WO | WO-2010/100448 | 9/2010 |
| WO | WO-2010/100449 | 9/2010 |
| WO | WO-2010/100451 | 9/2010 |
| WO | WO-2010/100452 | 9/2010 |
| WO | WO-2010/100453 | 9/2010 |
| WO | WO-2010/100462 | 9/2010 |
| WO | WO-2011/050041 | 4/2011 |
| WO | WO-2011/055134 | 5/2011 |
| WO | WO-2012/006882 | 1/2012 |
| WO | WO-2012/033517 | 3/2012 |
| WO | WO-2012/052737 | 4/2012 |
| WO | WO-2013/014419 | 1/2013 |

OTHER PUBLICATIONS

International Search Report and Written Opinion dated Jul. 7, 2010, directed to International Application No. PCT/GB2010/050267; 12 pages.

Reba, I. (1966). "Applications of the Coanda Effect," *Scientific American* 214:84-92.

Third Party Submission Under 37 CFR 1.99 filed Jun. 2, 2011, directed to U.S. Appl. No. 12/203,698; 3 pages.

Gammack et al., U.S. Office Action dated Dec. 9, 2010, directed to U.S. Appl. No. 12/203,698; 10 pages.

Gammack et al., U.S. Office Action dated Jun. 21, 2011, directed to U.S. Appl. No. 12/203,698; 11 pages.

Gammack et al., U.S. Office Action dated Sep. 17, 2012, directed to U.S. Appl. No. 13/114,707; 12 pages.

Gammack et al., U.S. Office Action dated Dec. 10, 2010, directed to U.S. Appl. No. 12/230,613; 12 pages.

Gammack et al., U.S. Office Action dated May 13, 2011, directed to U.S. Appl. No. 12/230,613; 13 pages.

(56) References Cited

OTHER PUBLICATIONS

Gammack et al., U.S. Office Action dated Sep. 7, 2011, directed to U.S. Appl. No. 12/230,613; 15 pages.
Gammack et al., U.S. Office Action dated Jun. 8, 2012, directed to U.S. Appl. No. 12/230,613; 15 pages.
Gammack et al., U.S. Office Action dated Aug. 20, 2012, directed to U.S. Appl. No. 12/945,558; 15 pages.
Gammack et al., U.S. Office Action dated Feb. 28, 2013, directed to U.S. Appl. No. 12/945,558; 16 pages.
Gammack et al., Office Action dated Jun. 12, 2013, directed to U.S. Appl. No. 12/945,558; 20 pages.
Fitton et al., U.S. Office Action dated Nov. 30, 2010 directed to U.S. Appl. No. 12/560,232; 9 pages.
Nicolas et al., U.S. Office Action dated Mar. 7, 2011, directed to U.S. Appl. No. 12/622,844; 10 pages.
Nicolas et al., U.S. Office Action dated Sep. 8, 2011, directed to U.S. Appl. No. 12/622,844; 11 pages.
Helps et al., U.S. Office Action dated Feb. 15, 2013, directed to U.S. Appl. No. 12/716,694; 12 pages.
Gammack et al., U.S. Office Action dated Dec. 9, 2010, directed to U.S. Appl. No. 12/716,781; 17 pages.
Gammack et al., U.S. Office Action dated Jun. 24, 2011, directed to U.S. Appl. No. 12/716,781; 19 pages.
Gammack et al. U.S. Office Action dated May 29, 2013, directed to U.S. Appl. No. 13/588,666; 11 pages.
Gammack et al., U.S. Office Action dated Sep. 27, 2013, directed to U.S. Appl. No. 13/588,666; 10 pages.
Gammack et al., U.S. Office Action dated Mar. 14, 2013, directed to U.S. Appl. No. 12/716,740; 15 pages.
Gammack et al., U.S. Office Action dated Sep. 6, 2013, directed to U.S. Appl. No. 12/716,740; 14 pages.
Gammack et al., U.S. Office Action dated Apr. 24, 2014, directed to U.S. Appl. No. 12/716,740; 16 pages.
Gammack et al., U.S. Office Action dated Jan. 16, 2015, directed to U.S. Appl. No. 12/716,740; 24 pages.
Li et al., U.S. Office Action dated Oct. 25, 2013, directed to U.S. Appl. No. 13/686,480; 17 pages.
Fitton et al., U.S. Office Action dated Jun. 13, 2014, directed to U.S. Appl. No. 13/274,998; 11 pages.
Fitton et al., U.S. Office Action dated Jun. 13, 2014, directed to U.S. Appl. No. 13/275,034; 10 pages.
Gammack et al., U.S. Office Action dated Feb. 14, 2013, directed to U.S. Appl. No. 12/716,515; 21 pages.
Gammack et al., U.S. Office Action dated Aug. 19, 2013, directed to U.S. Appl. No. 12/716,515; 20 pages.
Gammack et al., U.S. Office Action dated Feb. 10, 2014, directed to U.S. Appl. No. 12/716,515; 21 pages.
Fitton et al., U.S. Office Action dated Mar. 30, 2012, directed to U.S. Appl. No. 12/716,707; 7 pages.
Fitton et al., U.S. Office Action dated Dec. 31, 2013, directed to U.S. Appl. No. 13/718,693; 8 pages.
Staniforth et al., U.S. Office Action dated Sep. 18, 2014, directed to U.S. Appl. No. 13/559,142; 18 pages.
Gammack et al. U.S. Office Action dated Oct. 18, 2012, directed to U.S. Appl. No. 12/917,247; 11 pages.
Gammack et al., U.S. Office Action dated Sep. 3, 2014, directed to U.S. Appl. No. 13/861,891; 7 pages.
Wallace et al., U.S. Office Action dated Jun. 7, 2013, directed to U.S. Appl. No. 13/192,223; 30 pages.
Wallace et al., Office Action dated Oct. 23, 2013, directed to U.S. Appl. No. 13/192,223; 18 pages.
Gammack et al., U.S. Office Action dated Nov. 29, 2012, directed to U.S. Appl. No. 12/716,742; 9 pages.
Cookson et al., U.S. Office Action dated Dec. 19, 2012, directed to U.S. Appl. No. 12/716,778; 8 pages.
Hodgson et al., U.S. Office Action dated Mar. 24, 2014, directed to U.S. Appl. No. 13/207,212; 10 pages.
Cammack et al., U.S. Office Action dated Apr. 12, 2011, directed to U.S. Appl. No. 12/716,749; 8 pages.
Cammack et al., U.S. Office Action dated Sep. 1, 2011, directed to U.S. Appl. No. 12/716,749; 9 pages.
Cammack et al., U.S. Office Action dated Jun. 25, 2012, directed to U.S. Appl. No. 12/716,749; 11 pages.
Cammack et al., U.S. Office Action dated Jan. 7, 2013, directed to U.S. Appl. No. 12/716,749; 16 pages.
Cammack et al. U.S. Office Action dated Nov. 2, 2012, directed to U.S. Appl. No. 13/314,974; 8 pages.
Cammack et al., Office Action dated Jun. 6, 2013, directed to U.S. Appl. No. 13/314,974; 7 pages.
Cammack et al., U.S. Office Action dated Jun. 9, 2014, directed to U.S. Appl. No. 13/314,974; 9 pages.
Cammack et al., U.S. Office Action dated Oct. 23, 2014, directed to U.S. Appl. No. 13/314,974; 11 pages.
Cammack et al., U.S. Office Action dated May 24, 2011, directed to U.S. Appl. No. 12/716,613; 9 pages.
Cammack et al., U.S. Office Action dated Nov. 2, 2012, directed to U.S. Appl. No. 13/284,516; 9 pages.
Fitton et al., U.S. Office Action dated Mar. 8, 2011, directed to U.S. Appl. No. 12/716,780; 12 pages.
Fitton et al., U.S. Office Action dated Sep. 6, 2011, directed to U.S. Appl. No. 12/716,780; 16 pages.

* cited by examiner

FAN ASSEMBLY

REFERENCE TO RELATED APPLICATIONS

This application is a continuation of U.S. patent application Ser. No. 12/716,740, filed Mar. 3, 2010, which claims the priority of United Kingdom Application No. 0903665.8, filed Mar. 4, 2009, the entire contents of which are incorporated herein by reference.

FIELD OF THE INVENTION

The present invention relates to a fan assembly. Particularly, but not exclusively, the present invention relates to a domestic fan, such as a desk fan, for creating air circulation and air current in a room, in an office or other domestic environment.

BACKGROUND OF THE INVENTION

A conventional domestic fan typically includes a set of blades or vanes mounted for rotation about an axis, and drive apparatus for rotating the set of blades to generate an air flow. The movement and circulation of the air flow creates a 'wind chill' or breeze and, as a result, the user experiences a cooling effect as heat is dissipated through convection and evaporation.

Such fans are available in a variety of sizes and shapes. For example, a ceiling fan can be at least 1 m in diameter, and is usually mounted in a suspended manner from the ceiling to provide a downward flow of air to cool a room. On the other hand, desk fans are often around 30 cm in diameter, and are usually free standing and portable. Other types of fan can be attached to the floor or mounted on a wall. Fans such as that disclosed in U.S. D 103,476 and U.S. Pat. No. 1,767,060 are suitable for standing on a desk or a table.

A disadvantage of this type of fan is that the air flow produced by the rotating blades of the fan is generally not uniform. This is due to variations across the blade surface or across the outward facing surface of the fan. The extent of these variations can vary from product to product and even from one individual fan machine to another. These variations result in the generation of an uneven or 'choppy' air flow which can be felt as a series of pulses of air and which can be uncomfortable for a user. In addition, this type of fan can be noisy and the noise generated may become intrusive with prolonged use in a domestic environment. A further disadvantage is that the cooling effect created by the fan diminishes with distance from the user. This means that the fan must be placed in close proximity to the user in order for the user to experience the cooling effect of the fan.

An oscillating mechanism may be employed to rotate the outlet from the fan so that the air flow is swept over a wide area of a room. In this way the direction of air flow from the fan can be altered. In addition the drive apparatus may rotate the set of blades at a variety of speeds to optimise the airflow output by the fan. The blade speed adjustment and oscillating mechanism can lead to some improvement in the quality and uniformity of the air flow felt by a user although the characteristic 'choppy' air flow remains.

Some fans, sometimes known as or air circulators, generate a cooling flow of air without the use of rotating blades. Fans such as those described in U.S. Pat. No. 2,488,467 and JP 56-167897 have large base body portions including a motor and an impeller for generating an air flow in the base body. The air flow is channeled from the base body to an air discharge slot from which the air flow is projected forward towards a user. The fan of U.S. Pat. No. 2,488,467 emits air flow from a series of concentric slots, whereas the fan of JP 56-167897 channels the air flow to a neck piece leading to a single air discharging slot. The large base body portions, the neck and the one or more air discharging slots limit the arrangement and orientation of components of the fan.

A fan that attempts to provide cooling air flow through a slot without the use of rotating blades requires an efficient transfer of air flow from the base body to the slot. The air flow is constricted as it is channeled into the slot and this constriction creates pressure in the fan which must be overcome by the air flow generated by the motor and the impeller in order to project the air flow from the slot. Any inefficiencies in the system, for example losses through the fan housing or disruptions in the air flow path, will reduce the air flow from the fan. The high efficiency requirement restricts the options for the use of motors and other means for creating air flow. This type of fan can be noisy as vibrations generated by the motor and impeller and any turbulence in the air flow tend to be transmitted and amplified.

SUMMARY OF THE INVENTION

The present invention provides a bladeless fan assembly for creating an air current, the fan assembly comprising a nozzle mounted on a base, the nozzle comprising an interior passage and a mouth for receiving an air flow from the interior passage and through which the air flow is emitted from the fan assembly, the nozzle defining an opening through which air from outside the fan assembly is drawn by the air flow emitted from the mouth, wherein the nozzle is detachable from the base.

Without the support structure often provided by a set of rotating blades, noise and vibrations generated by the motor can be transmitted and amplified within the fan assembly. A detachable nozzle provides access to the interior passage of the nozzle and the outer casing of the base so that sound absorbing components can be incorporated into the nozzle and also the base. The detachable nature of the nozzle allows repeated access to the interior meaning that the noise and vibration reducing components, such as acoustic foam, can be replaced or repositioned easily. Silencing components can be modified and matched to reduce the noise and vibrations generated by a particular fan assembly. The arrangement is also convenient for manufacture and assembly.

Preferably, the nozzle is detached from the base through rotation of the nozzle relative to the base. The nozzle and the base may comprise co-operating screw threads to allow the nozzle to be attached to, and subsequently detached from, the base. Alternatively, the nozzle may comprise a detent for releasably engaging a portion of the base to inhibit rotation of the nozzle relative to the base. The portion of the base is preferably in the form of, or comprises, a wedge. The detent preferably comprises an inclined surface which is configured to slide over an inclined surface of the wedge as the nozzle is rotated relative to the base to attach the nozzle to the base. Opposing surfaces of the detent and the wedge subsequently inhibit rotation of the nozzle relative to the base during use of the fan assembly to prevent the nozzle from becoming inadvertently detached from the base. The detent is preferably arranged to flex out of engagement with said portion of the base, for example due to the user applying a relatively large rotational force to the nozzle, to detach the nozzle from the base. Thus assembly and disassembly can each be performed in one operation or twist movement, and could be performed by an unskilled user of the fan assembly or manufacturing operative.

The nozzle may comprise a second detent for releasably engaging a portion of the base to inhibit movement of the nozzle away from the base. This second detent may locate within a circumferentially extending portion of a groove formed on the outer surface of the base as the nozzle is attached to the base. This prevents the nozzle from becoming detached from the base if, for example, the fan assembly is picked up by a user grasping the nozzle.

In a preferred embodiment the opening is sized to accommodate the base. The arrangement provides for the base, when detached from the nozzle, to be stored within the opening, for transport and shipping for example. The nozzle part may be reattached to the base and assembled at the shipping destination, leading to a reduction in packaging and shipping costs. The base could also be connected and attached to an alternative nozzle increasing user choice and fan options. The nozzle preferably has a height extending from the end of the nozzle remote from the base to the end of the nozzle adjacent the base, the base having a height extending from the end of the base remote from the nozzle to the end of the base adjacent the nozzle, and wherein the height of the base is no more than 75% the height of the nozzle. More preferably, the height of the base is in the range from 65% to 55% of the height of the nozzle, and most preferably around 59% the height of the nozzle. The size of the base should preferably allow for a suitably loose fit of the base within the nozzle to provide room for protective packaging and support. Preferably, the height of the fan assembly is in the range 300 mm to 400 mm, preferably around 350 mm.

Preferably the base is substantially cylindrical. This arrangement can be compact with base dimensions that are small compared to those of the nozzle and compared to the size of the overall fan assembly. Advantageously, the invention can provide a fan assembly delivering a suitable cooling effect from a footprint smaller than that of prior art fans.

Preferably, the nozzle extends about a nozzle axis to define the opening through which air from outside the fan assembly is drawn by the air flow emitted from the mouth. Preferably, the nozzle surrounds the opening.

The fan assembly is in the form of a bladeless fan assembly. Through use of a bladeless fan assembly an air current can be generated without the use of a bladed fan. Without the use of a bladed fan to project the air current from the fan assembly, a relatively uniform air current can be generated and guided into a room or towards a user. The air current can travel efficiently out from the outlet, losing little energy and velocity to turbulence.

The term 'bladeless' is used to describe a fan assembly in which air flow is emitted or projected forward from the fan assembly without the use of moving blades. Consequently, a bladeless fan assembly can be considered to have an output area, or emission zone, absent moving blades from which the air flow is directed towards a user or into a room. The output area of the bladeless fan assembly may be supplied with a primary air flow generated by one of a variety of different sources, such as pumps, generators, motors or other fluid transfer devices, and which may include a rotating device such as a motor rotor and/or a bladed impeller for generating the air flow. The generated primary air flow can pass from the room space or other environment outside the fan assembly into the fan assembly, and then back out to the room space through the outlet.

Hence, the description of a fan assembly as bladeless is not intended to extend to the description of the power source and components such as motors that are required for secondary fan functions. Examples of secondary fan functions can include lighting, adjustment and oscillation of the fan assembly.

The mouth is preferably located towards the rear of the nozzle. The nozzle preferably comprises a surface, preferably a Coanda surface, located adjacent the mouth and over which the mouth is arranged to direct the air flow emitted therefrom. Preferably, the external surface of the inner casing section of the nozzle is shaped to define the Coanda surface. The Coanda surface preferably extends about the opening. A Coanda surface is a known type of surface over which fluid flow exiting an output orifice close to the surface exhibits the Coanda effect. The fluid tends to flow over the surface closely, almost 'clinging to' or 'hugging' the surface. The Coanda effect is already a proven, well documented method of entrainment in which a primary air flow is directed over a Coanda surface. A description of the features of a Coanda surface, and the effect of fluid flow over a Coanda surface, can be found in articles such as Reba, Scientific American, Volume 214, June 1966 pages 84 to 92. Through use of a Coanda surface, an increased amount of air from outside the fan assembly is drawn through the opening by the air emitted from the mouth.

Preferably, an air flow enters the nozzle of the fan assembly from the base. In the following description this air flow will be referred to as primary air flow. The primary air flow is emitted from the mouth of the nozzle and preferably passes over a Coanda surface. The primary air flow entrains air surrounding the mouth of the nozzle, which acts as an air amplifier to supply both the primary air flow and the entrained air to the user. The entrained air will be referred to here as a secondary air flow. The secondary air flow is drawn from the room space, region or external environment surrounding the mouth of the nozzle and, by displacement, from other regions around the fan assembly, and passes predominantly through the opening defined by the nozzle. The primary air flow directed over the Coanda surface combined with the entrained secondary air flow equates to a total air flow emitted or projected forward from the opening defined by the nozzle. Preferably, the entrainment of air surrounding the mouth of the nozzle is such that the primary air flow is amplified by at least five times, more preferably by at least ten times, while a smooth overall output is maintained.

Preferably, the nozzle comprises a diffuser surface located downstream of the Coanda surface. The external surface of the inner casing section of the nozzle is preferably shaped to define the diffuser surface.

The base preferably comprises means for generating the air flow. The means for generating the air flow preferably comprises an impeller and a motor for rotating the impeller to create the air flow. The impeller is preferably a mixed flow impeller. Preferably there is a diffuser located within the impeller housing and downstream from the impeller. The motor is preferably a DC brushless motor to avoid frictional losses and carbon debris from the brushes used in a traditional brushed motor. Reducing carbon debris and emissions is advantageous in a clean or pollutant sensitive environment such as a hospital or around those with allergies. While induction motors, which are generally used in fans, also have no brushes, a DC brushless motor can provide a much wider range of operating speeds than an induction motor.

The base preferably comprises means for inhibiting removal of said means for generating the air flow from the base when the nozzle is detached from the base. The means for inhibiting removal of said means for generating the air flow from the base preferably comprises a retainer located over said means for generating the air flow. The means for generating the air flow preferably comprises a motor located within a motor housing, and wherein said means for inhibiting removal of said means for generating the air flow from the base is preferably arranged to allow movement of the motor housing relative to the base to reduce the transmission of vibrations from the motor housing to the base during use of the fan assembly.

The impeller is preferably housed within an impeller housing having an air inlet and an air outlet. The base of the fan assembly preferably comprises means for directing a portion of the air flow from the air outlet of the impeller housing towards the interior passage of the nozzle.

The direction in which air is emitted from the air outlet of the impeller housing is preferably substantially at a right angle to the direction in which the air flow passes through at least part of the interior passage. The interior passage is preferably annular, and is preferably shaped to divide the air flow into two air streams which flow in opposite directions around the opening. In the preferred embodiment, the air flow passes into at least part of the interior passage in a sideways direction, and the air is emitted from the air outlet of the impeller housing in a forward direction. In view of this, the means for directing a portion of the air flow from the air outlet of the impeller housing preferably comprises at least one curved vane. The or each curved vane is preferably shaped to change the direction of the air flow by around 90°. The curved vanes are shaped so that there is no significant loss in the velocity of the portions of the air flow as they are directed into the interior passage.

Preferably, the mouth of the nozzle extends about the opening, and is preferably annular. Preferably the nozzle extends about the opening by a distance in the range from 50 to 250 cm. The nozzle preferably comprises at least one wall defining the interior passage and the mouth, and wherein said at least one wall comprises opposing surfaces defining the mouth. Preferably, the mouth has an outlet, and the spacing between the opposing surfaces at the outlet of the mouth is in the range from 0.5 mm to 5 mm, more preferably in the range from 0.5 mm to 1.5 mm. The nozzle may comprise an inner casing section and an outer casing section which define the mouth of the nozzle. Each section is preferably formed from a respective annular member, but each section may be provided by a plurality of members connected together or otherwise assembled to form that section. The outer casing section is preferably shaped so as to partially overlap the inner casing section. This can enable an outlet of the mouth to be defined between overlapping portions of the external surface of the inner casing section and the internal surface of the outer casing section of the nozzle. The nozzle may comprise a plurality of spacers for urging apart the overlapping portions of the inner casing section and the outer casing section of the nozzle. This can assist in maintaining a substantially uniform outlet width about the opening. The spacers are preferably evenly spaced along the outlet.

The base preferably comprises control means for controlling the fan assembly. For safety reasons and ease of use, it can be advantageous to locate control elements away from the nozzle so that the control functions, such as, for example, oscillation, tilting, lighting or activation of a speed setting, are not activated during a fan operation.

The maximum air flow of the air current generated by the fan assembly is preferably in the range from 300 to 800 liters per second, more preferably in the range from 500 to 800 liters per second.

BRIEF DESCRIPTION OF THE DRAWINGS

An embodiment of the invention will now be described with reference to the accompanying drawings, in which:

FIG. 2(*b*) is a perspective view of the nozzle of the fan assembly of FIG. 1;

FIG. 2(*c*) is a lower perspective view of a portion of the nozzle of the fan assembly of FIG. 1;

FIG. 5(*b*) is a side view of the fan assembly of FIG. 1 showing the fan assembly in a first tilted position;

FIG. 5(*c*) is a side view of the fan assembly of FIG. 1 showing the fan assembly in a second tilted position;

FIG. 9(*b*) is a sectional view along line A-A of FIG. 9(*a*);

FIG. 9(*c*) is a sectional view along line B-B of FIG. 9(*a*);

FIG. 10(*b*) is a sectional view along line C-C of FIG. 10(*a*); and

FIG. 10(*c*) is a sectional view along line D-D of FIG. 10(*a*).

DETAILED DESCRIPTION OF THE INVENTION

Figure 1:
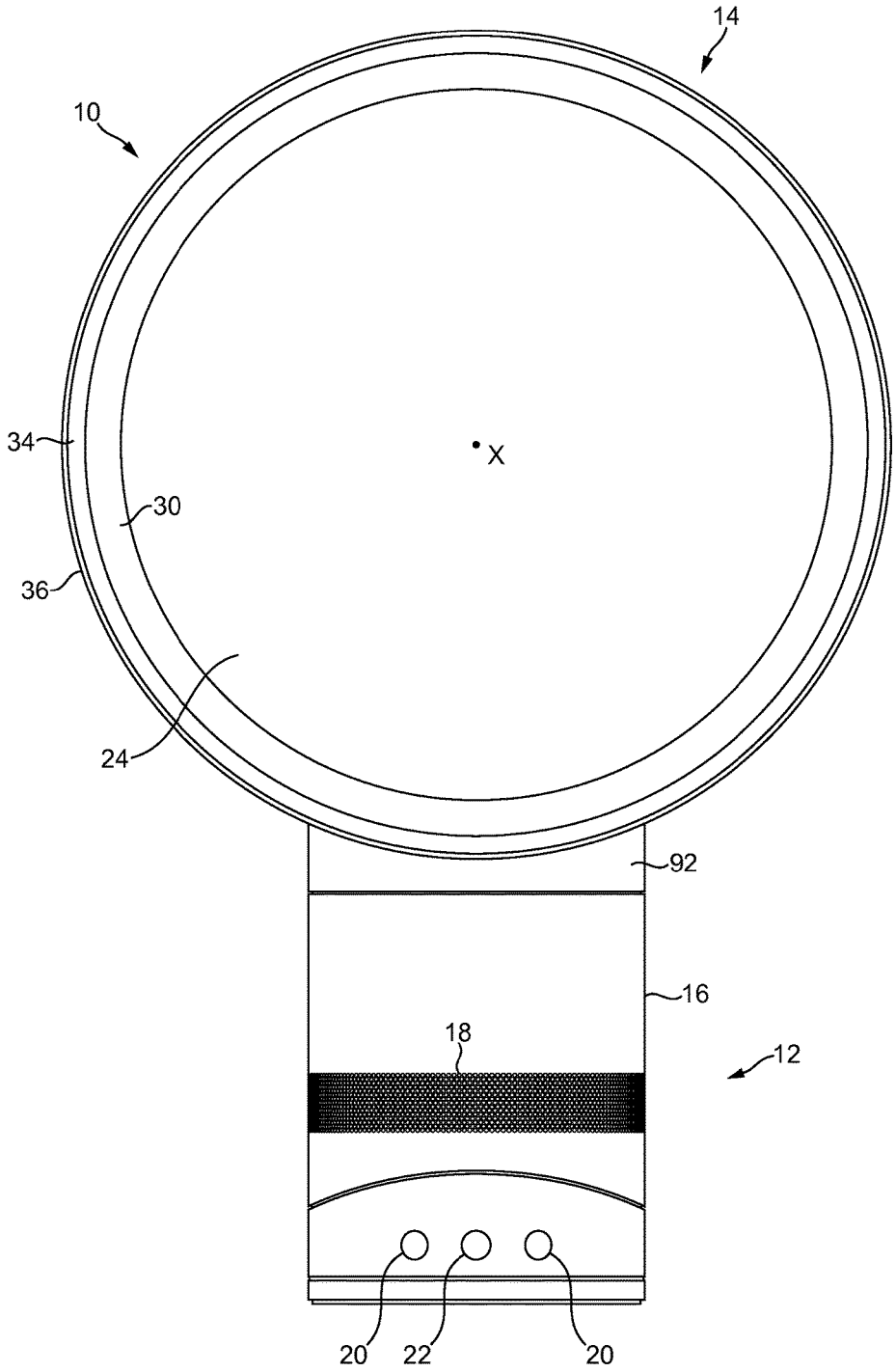
FIG. 1 is a front view of a fan assembly.
Figure 2A:
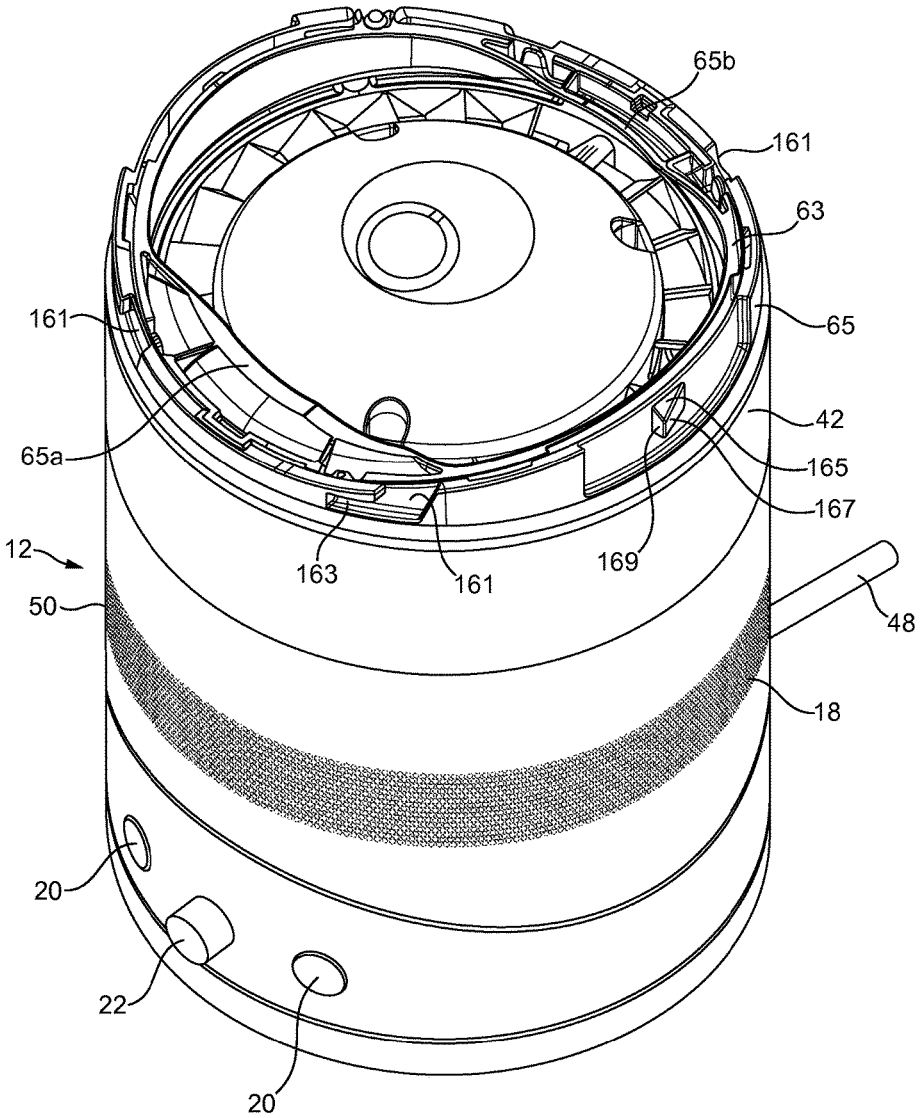
FIG. 2(*a*) is a perspective view of the base of the fan assembly of FIG. 1.
Figure 2B:
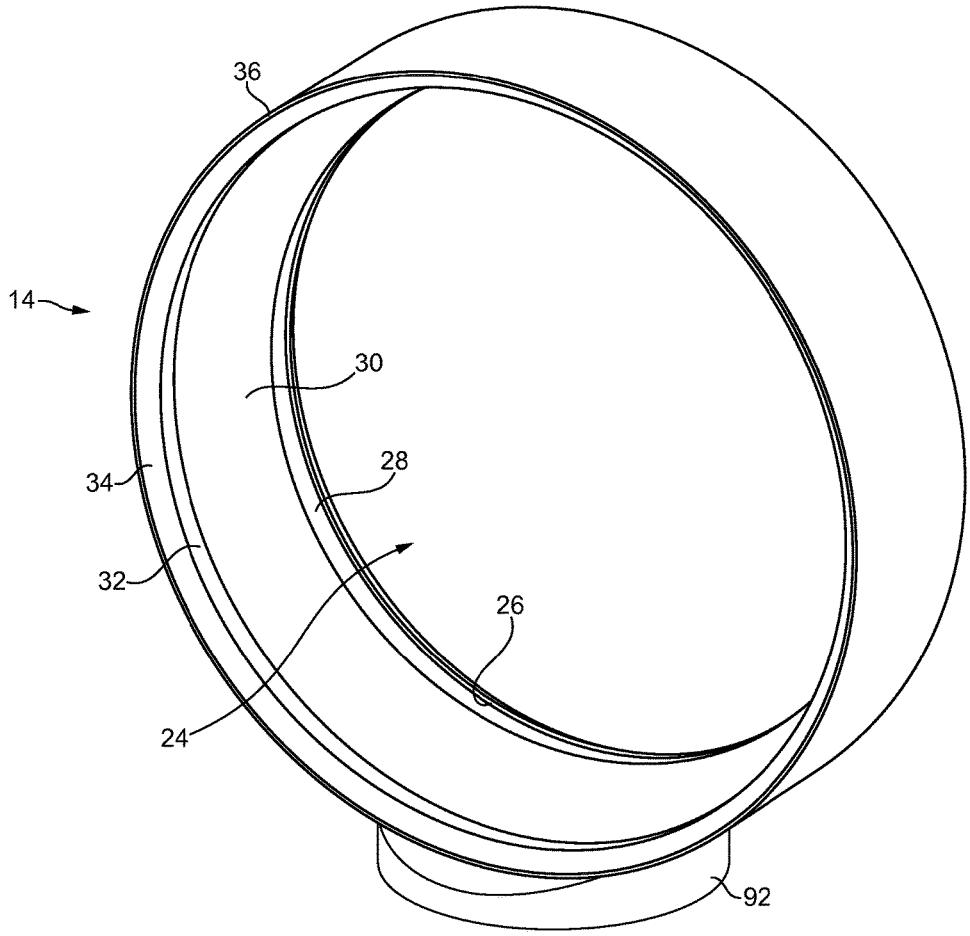
Figure 2C:
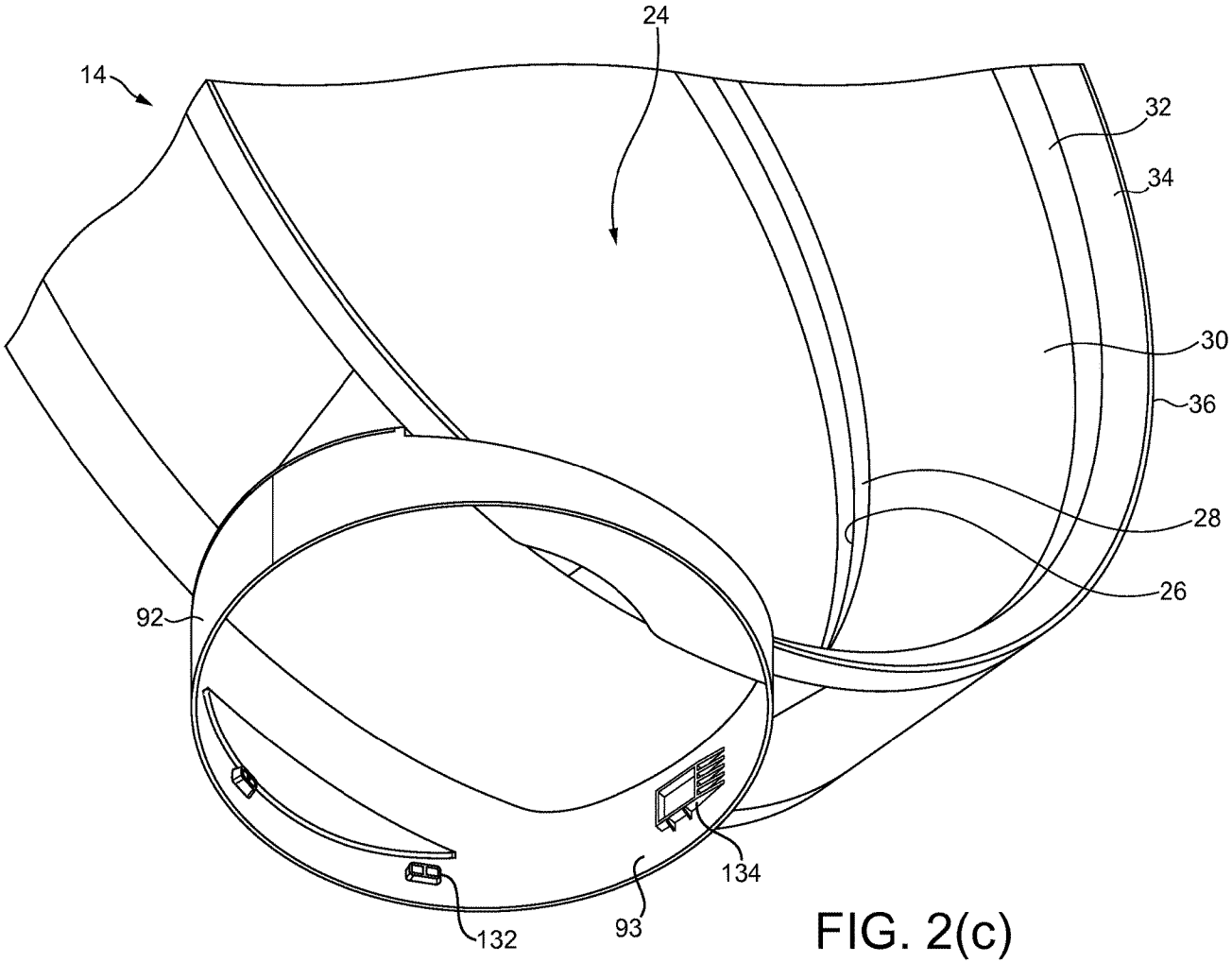

FIG. 1 is a front view of a fan assembly 10. The fan assembly 10 is preferably in the form of a bladeless fan assembly comprising a base 12 and a nozzle 14 mounted on, detachable from, and supported by the base 12. With reference to FIG. 2(*a*), the base 12 comprises a substantially cylindrical outer casing 16 having a plurality of air inlets 18 in the form of apertures located in the outer casing 16 and through which a primary air flow is drawn into the base 12 from the external environment. The base 12 further comprises a plurality of user-operable buttons 20 and a user-operable dial 22 for controlling the operation of the fan assembly 10. In this example the base 12 has a height in the range from 200 to 300 mm, and the outer casing 16 has an external diameter in the range from 100 to 200 mm.

With reference also to FIG. 2(*b*), the nozzle 14 has an annular shape and defines a central opening 24. The nozzle 14 has a height in the range from 200 to 400 mm. The nozzle 14 comprises a mouth 26 located towards the rear of the fan assembly 10 for emitting air from the fan assembly 10 and through the opening 24. The mouth 26 extends at least partially about the opening 24. The inner periphery of the nozzle 14 comprises a Coanda surface 28 located adjacent the mouth 26 and over which the mouth 26 directs the air emitted from the fan assembly 10, a diffuser surface 30 located downstream of the Coanda surface 28 and a guide surface 32 located downstream of the diffuser surface 30. The diffuser surface 30 is arranged to taper away from the central axis X of the opening 24 in such a way so as to assist the flow of air emitted from the fan assembly 10. The angle subtended between the diffuser surface 30 and the central axis X of the opening 24 is in the range from 5 to 25°, and in this example is around 15°. The guide surface 32 is arranged at an angle to the diffuser surface 30 to further assist the efficient delivery of a cooling air flow from the fan assembly 10. The guide surface 32 is preferably arranged substantially parallel to the central axis X of the opening 24 to present a substantially flat and substantially smooth face to the air flow emitted from the mouth 26. A visually appealing tapered surface 34 is located downstream from the guide surface 32, terminating at a tip surface 36 lying substantially perpendicular to the central axis X of the opening 24. The angle subtended between the tapered surface 34 and the central axis X of the opening 24 is preferably around 45°. The overall depth of the nozzle 24 in a direction extending along the central axis X of the opening 24 is in the range from 100 to 150 mm, and in this example is around 110 mm.

Figure 3:
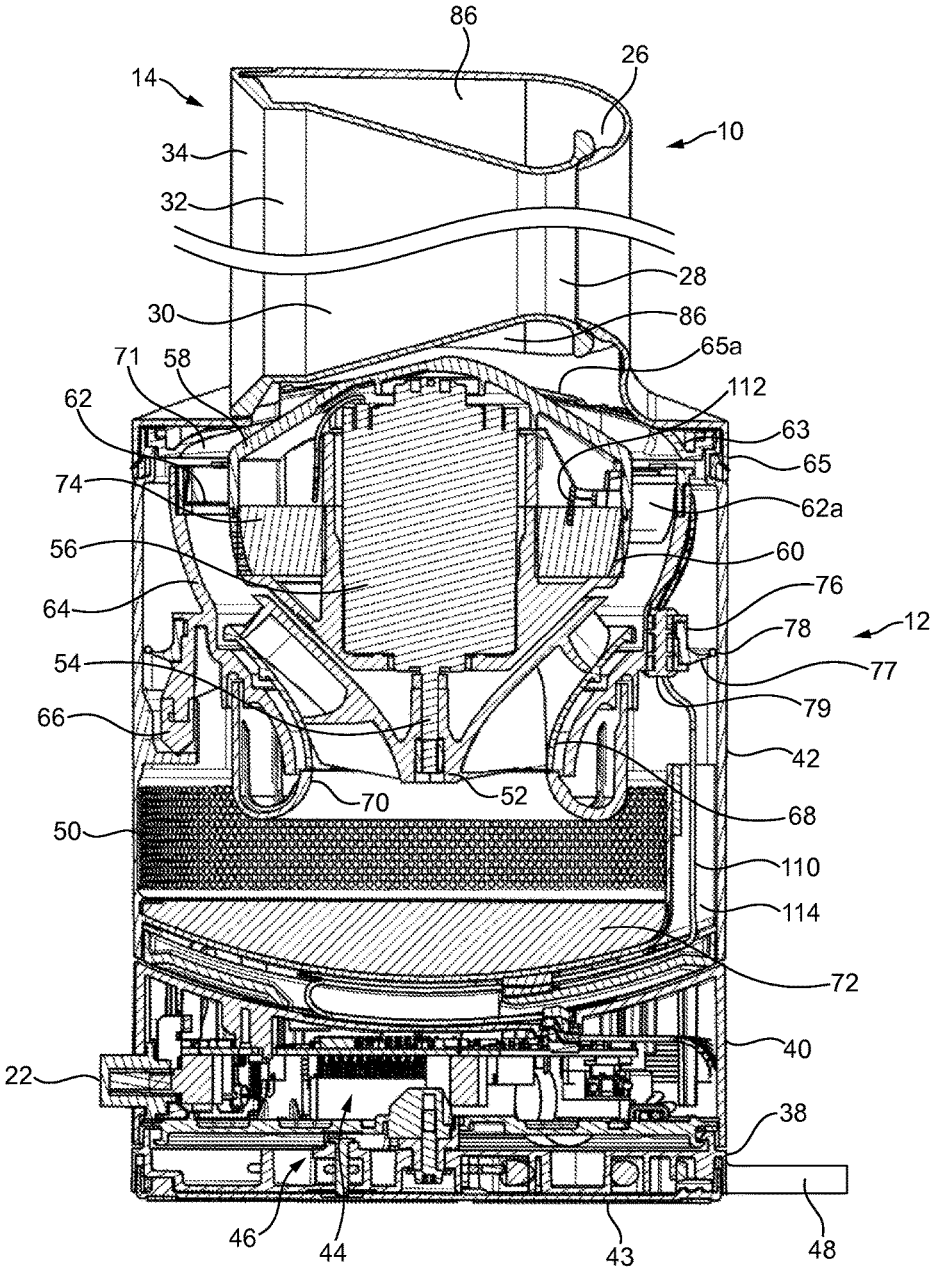
FIG. 3 is a sectional view through the fan assembly of FIG. 1.

FIG. 3 illustrates a sectional view through the fan assembly 10. The base 12 comprises a lower base member 38, an intermediary base member 40 mounted on the lower base member 38, and an upper base member 42 mounted on the intermediary base member 40. The lower base member 38 has a substantially flat bottom surface 43. The intermediary base member 40 houses a controller 44 for controlling the operation of the fan assembly 10 in response to depression of the user operable buttons 20 shown in FIGS. 1 and 2(*a*), and/or manipulation of the user operable dial 22. The intermediary base member 40 may also house an oscillating mechanism 46 for oscillating the intermediary base member 40 and the upper base member 42 relative to the lower base member 38. The range of each oscillation cycle of the upper base member 42 is preferably between 60° and 120°, and in this example is around 90°. In this example, the oscillating mechanism 46 is arranged to perform around 3 to 5 oscillation cycles per minute. A mains power cable 48 extends through an aperture formed in the lower base member 38 for supplying electrical power to the fan assembly 10.

The upper base member 42 of the base 12 has an open upper end. The upper base member 42 comprises a cylindrical grille mesh 50 in which an array of apertures is formed. In between each aperture are side wall regions known as 'lands'. The apertures provide the air inlets 18 of the base 12. A percentage of the total surface area of the cylindrical base is an open area equivalent to the total surface area of the apertures. In the illustrated embodiment the open area is 33% of the total mesh area, each aperture has a diameter of 1.2 mm and 1.8 mm from aperture centre to aperture centre, providing 0.6 mm of land in between each aperture. Aperture open area is required for air flow into the fan assembly, but large apertures can transmit vibrations and noise from the motor to the external environment. An open area of around 30% to 45% provides a compromise between lands to inhibit the emission of noise and openings for free, unrestricted inflow of air into the fan assembly.

The upper base member 42 houses an impeller 52 for drawing the primary air flow through the apertures of the grille mesh 50 and into the base 12. Preferably, the impeller 52 is in the form of a mixed flow impeller. The impeller 52 is connected to a rotary shaft 54 extending outwardly from a motor 56. In this example, the motor 56 is a DC brushless motor having a speed which is variable by the controller 44 in response to user manipulation of the dial 22. The maximum speed of the motor 56 is preferably in the range from 5,000 to 10,000 rpm. The motor 56 is housed within a motor bucket comprising an upper portion 58 connected to a lower portion 60. The motor bucket is retained within the upper base member 42 by a motor bucket retainer 63. The upper end of the upper base member 42 comprises a cylindrical outer surface 65. The motor bucket retainer 63 is connected to the open upper end of the upper base member 42, for example by a snap-fit connection. The motor 56 and its motor bucket are not rigidly connected to the motor bucket retainer 63, allowing some movement of the motor 56 within the upper base member 42.

The upper end of the upper base member 42 comprises two pairs of open grooves 161 formed by removing part of the outer surface 65 to leave a shaped 'cutaway' portion. The upper end of each of the grooves 161 is in open communication with the open upper end of the upper base member 42. The open groove 161 is arranged to extend downwardly from the open upper end of the upper base member 42. A lower part of the groove 161 comprises a horizontally extending track 163 having upper and lower portions bounded by the outer surface 65 of the upper base member 42. Each pair of open grooves 161 is located symmetrically about the upper end of the upper base member 42, the pairs being spaced circumferentially from each other.

The cylindrical outer surface 65 of the upper end of the upper base member 42 further comprises a pair of wedge members 165 having a tapered part 167 and a side wall 169. The wedge members 165 are located on opposite sides of the upper base member 42, with each wedge member 165 being located within a respective cutaway portion of the outer surface 65.

The motor bucket retainer 63 comprises curved vane portions 65*a* and 65*b* extending inwardly from the upper end of the motor bucket retainer 63. Each curved vane 65*a*, 65*b* overlaps a part of the upper portion 58 of the motor bucket. Thus the motor bucket retainer 63 and the curved vanes 65*a* and 65*b* act to secure and hold the motor bucket in place during movement and handling. In particular, the motor bucket retainer 63 prevents the motor bucket becoming dislodged and falling towards the nozzle 14 if the fan assembly 10 becomes inverted.

One of the upper portion 58 and the lower portion 60 of the motor bucket comprises a diffuser 62 in the form of a stationary disc having spiral fins 62*a*, and which is located downstream from the impeller 52. One of the spiral fins 62*a* has a substantially inverted U-shaped cross-section when sectioned along a line passing vertically through the upper base member 42. This spiral fin 62*a* is shaped to enable a power connection cable to pass through the fin 62*a*.

The motor bucket is located within, and mounted on, an impeller housing 64. The impeller housing 64 is, in turn, mounted on a plurality of angularly spaced supports 66, in this example three supports, located within the upper base member 42 of the base 12. A generally frusto-conical shroud 68 is located within the impeller housing 64. The shroud 68 is shaped so that the outer edges of the impeller 52 are in close proximity to, but do not contact, the inner surface of the shroud 68. A substantially annular inlet member 70 is connected to the bottom of the impeller housing 64 for guiding the primary air flow into the impeller housing 64. The top of the grille mesh 50 is spaced above the inlet member 70 by around 5 mm. The height of the grille mesh 50 is preferably around 25 mm but may be between 15 and 35 mm. The top of the impeller housing 64 comprises a substantially annular air outlet 71 for guiding air flow emitted from the impeller housing 64 towards the nozzle 14.

Preferably, the base 12 further comprises silencing members for reducing noise emissions from the base 12. In this example, the upper base member 42 of the base 12 comprises a disc-shaped foam member 72 located towards the base of the upper base member 42, and a substantially annular foam member 74 located within the impeller housing 64. The bottom of the grille mesh 50 is located at substantially the same height as, and in close proximity to, the upper surface of the disc-shaped foam member 72.

In this embodiment the air inlet member 70 is spaced from the disc-shaped foam member 72 by a distance of around 17 to 20 mm. A surface area of an air inlet region of the upper base member 42 may be considered to comprise the circumference of the air inlet member 70 multiplied by the distance from the air inlet member 70 to the upper surface of the disc-shaped foam member 72. The surface area of the air inlet region in the illustrated embodiment provides a balance between a volume of foam required to absorb reflected noise and vibrations from the motor and an air inlet region sized to enable a primary flow rate of up to 30 liters per second. A fan assembly providing a greater volume of foam would necessarily reduce the air inlet region causing a restriction or pinch in the air flow into the impeller. Restricting the flow of air to the impeller and motor could cause the motor to choke or strain and generate excess noise.

A flexible sealing member is mounted on the impeller housing 64. The flexible sealing member inhibits the return of air to the air inlet member 70 along a path extending between the outer casing 16 and the impeller housing 64 by separating the primary air flow drawn in from the external environment from the air flow emitted from the air outlet 71 of the impeller 52 and diffuser 62. The sealing member preferably comprises a lip seal 76. The sealing member is annular in shape and surrounds the impeller housing 64, extending outwardly from the impeller housing 64 towards the outer casing 16. In the illustrated embodiment the diameter of the sealing member is greater than the radial distance from the impeller housing 64 to the outer casing 16. Thus the outer portion 77 of the sealing member is biased against the outer casing 16 and caused to extend along the inner face of the outer casing 16, forming a seal. The lip seal 76 of the preferred embodiment tapers and narrows to a tip 78 as it extends away from the impeller housing 64 and towards the outer casing 16. The lip seal 76 is preferably formed from rubber.

The lip seal 76 further comprises a guide portion for guiding a power connection cable to the motor 56. The guide portion 79 of the illustrated embodiment is formed in the shape of a collar and may be a grommet.

Figure 4:
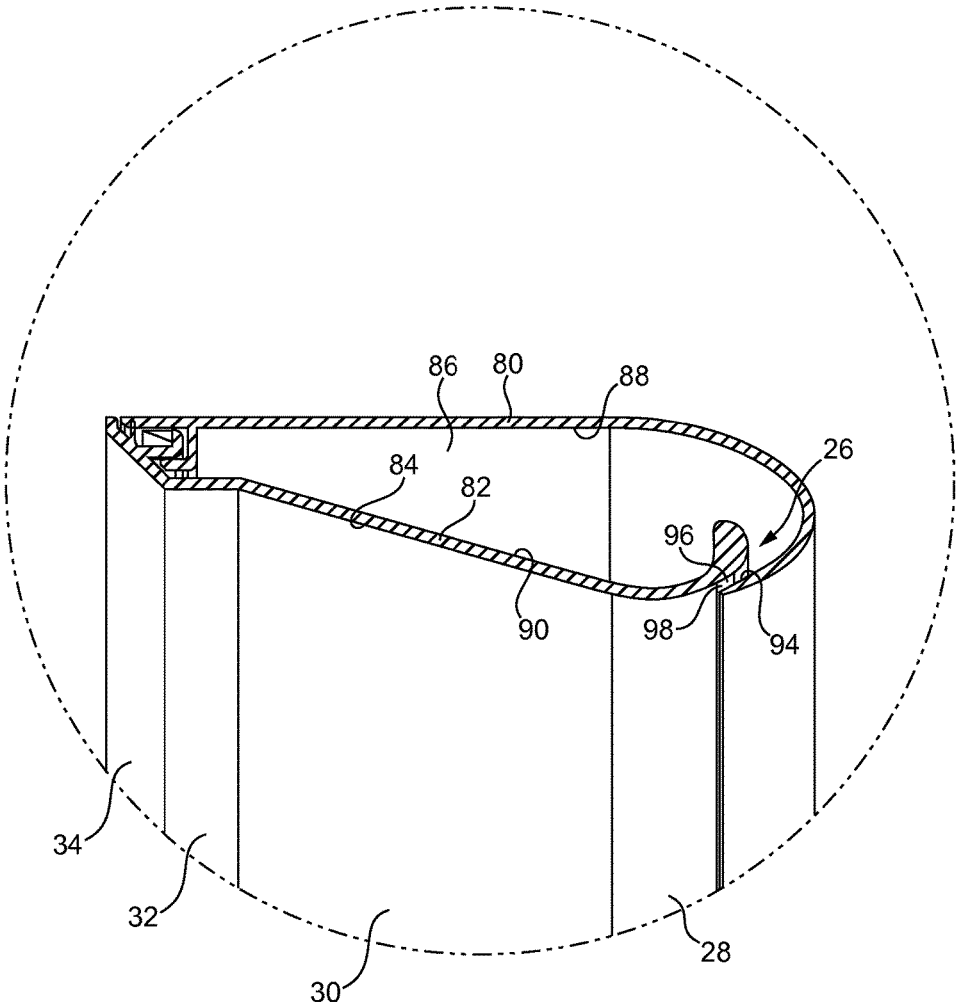
FIG. 4 is an enlarged view of part of FIG. 3.

FIG. 4 illustrates a sectional view through the nozzle 14. The nozzle 14 comprises an annular outer casing section 80 connected to and extending about an annular inner casing section 82. Each of these sections may be formed from a plurality of connected parts, but in this embodiment each of the outer casing section 80 and the inner casing section 82 is formed from a respective, single moulded part. The inner casing section 82 defines the central opening 24 of the nozzle 14, and has an external peripheral surface 84 which is shaped to define the Coanda surface 28, diffuser surface 30, guide surface 32 and tapered surface 34.

The outer casing section 80 and the inner casing section 82 together define an annular interior passage 86 of the nozzle 14. Thus, the interior passage 86 extends about the opening 24. The interior passage 86 is bounded by the internal peripheral surface 88 of the outer casing section 80 and the internal peripheral surface 90 of the inner casing section 82. The outer casing section 80 comprises a base 92 having an inner surface 93 and two pairs of lugs 132 and a pair of ramps 134 for connection to the upper end of the upper base member 42. Each one of the lugs and each one of the ramps 134 are located on, and upstand from, the inner surface 93. Thus the base 92 is connected to, and over, the open upper end of the motor bucket retainer 63 and the upper base member 42 of the base 12. The pairs of lugs 132 are located around the outer casing section 80 and spaced from each other so that the pairs of lugs 132 correspond to the spaced arrangement of the pairs of open grooves 161 of the upper end of the upper base member 42 and so that the location of the pair of ramps 134 corresponds to the location of the pair of wedge members 165 of the upper end of the upper base member 42.

The base 92 of the outer casing section 80 comprises an aperture through which the primary air flow enters the interior passage 86 of the nozzle 14 from the upper end of the upper base member 42 of the base 12 and the open upper end of the motor bucket retainer 63.

The mouth 26 of the nozzle 14 is located towards the rear of the fan assembly 10. The mouth 26 is defined by overlapping, or facing, portions 94, 96 of the internal peripheral surface 88 of the outer casing section 80 and the external peripheral surface 84 of the inner casing section 82, respectively. In this example, the mouth 26 is substantially annular and, as illustrated in FIG. 4, has a substantially U-shaped cross-section when sectioned along a line passing diametrically through the nozzle 14. In this example, the overlapping portions 94, 96 of the internal peripheral surface 88 of the outer casing section 80 and the external peripheral surface 84 of the inner casing section 82 are shaped so that the mouth 26 tapers towards an outlet 98 arranged to direct the primary flow over the Coanda surface 28. The outlet 98 is in the form of an annular slot, preferably having a relatively constant width in the range from 0.5 to 5 mm. In this example the outlet 98 has a width of around 1.1 mm Spacers may be spaced about the mouth 26 for urging apart the overlapping portions 94, 96 of the internal peripheral surface 88 of the outer casing section 80 and the external peripheral surface 84 of the inner casing section 82 to maintain the width of the outlet 98 at the desired level. These spacers may be integral with either the internal peripheral surface 88 of the outer casing section 80 or the external peripheral surface 84 of the inner casing section 82.

Figure 5A:
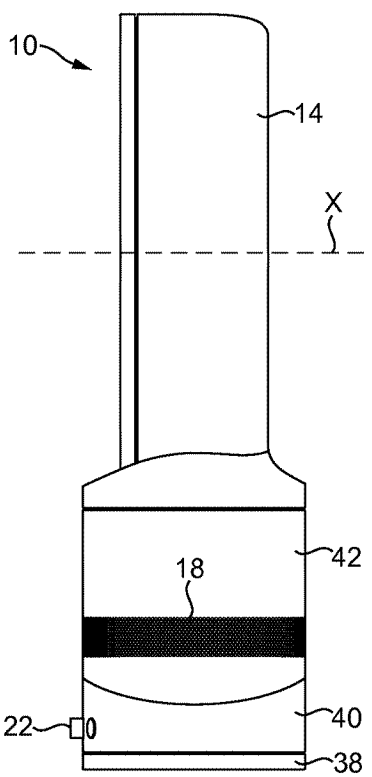
FIG. 5(*a*) is a side view of the fan assembly of FIG. 1 showing the fan assembly in an untilted position.
Figure 5B:
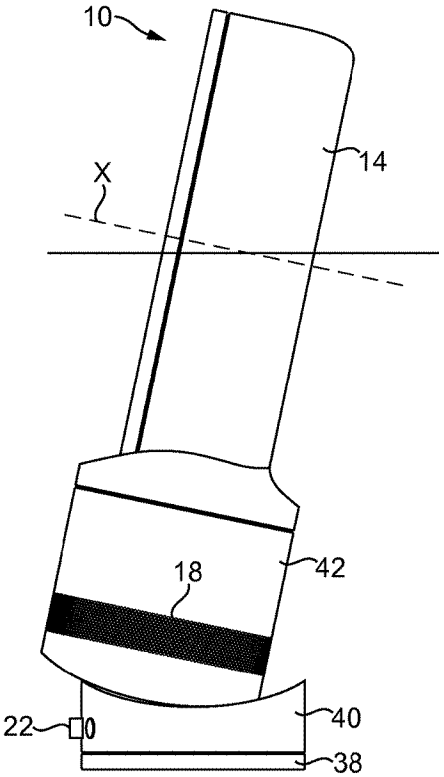
Figure 5C:
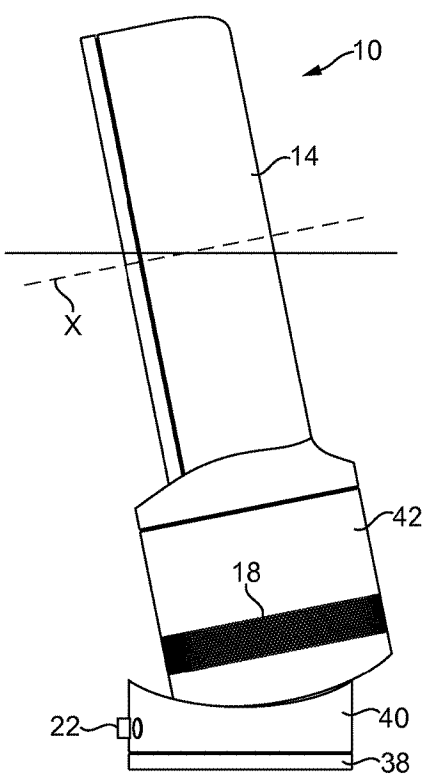

Turning now to FIGS. 5(*a*), 5(*b*) and 5(*c*), the upper base member 42 is moveable relative to the intermediary base member 40 and the lower base member 38 of the base 12 between a first fully tilted position, as illustrated in FIG. 5(*b*), and a second fully tilted position, as illustrated in FIG. 5(*c*). This axis X is preferably inclined by an angle of around 10° as the main body is moved from an untilted position, as illustrated in FIG. 5(*a*) to one of the two fully tilted positions. The outer surfaces of the upper base member 42 and the intermediary base member 40 are shaped so that adjoining portions of these outer surfaces of the upper base member 42 and the base 12 are substantially flush when the upper base member 42 is in the untilted position.

Figure 6:
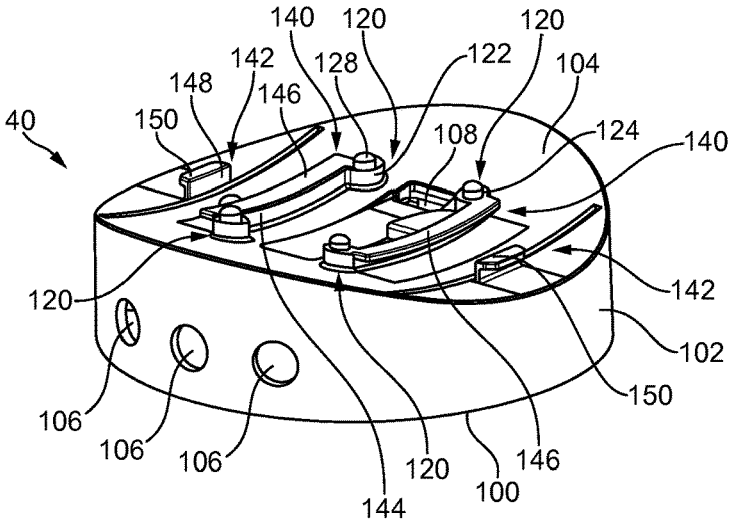
FIG. 6 is a top perspective view of the upper base member of the fan assembly of FIG. 1.

With reference to FIG. 6, the intermediary base member 40 comprises an annular lower surface 100 which is mounted on the lower base member 38, a substantially cylindrical side wall 102 and a curved upper surface 104. The side wall 102 comprises a plurality of apertures 106. The user-operable dial 22 protrudes through one of the apertures 106 whereas the user-operable buttons 20 are accessible through the other apertures 106. The curved upper surface 104 of the intermediary base member 40 is concave in shape, and may be described as generally saddle-shaped. An aperture 108 is formed in the upper surface 104 of the intermediary base member 40 for receiving an electrical cable 110 (shown in FIG. 3) extending from the motor 56.

Returning to FIG. 3 the electrical cable 110 is a ribbon cable attached to the motor at joint 112. The electrical cable 110 extending from the motor 56 passes out of the lower portion 60 of the motor bucket through spiral fin 62*a*. The passage of the electrical cable 110 follows the shaping of the impeller housing 64 and the guide portion 79 of the lip seal 76 is shaped to enable the electrical cable 110 to pass through the flexible sealing member. The collar of the lip seal 76 enables the electrical cable to be clamped and held within the upper base member 42. A cuff 114 accommodates the electrical cable 110 within the lower portion of the upper base member 42.

Figure 9A:
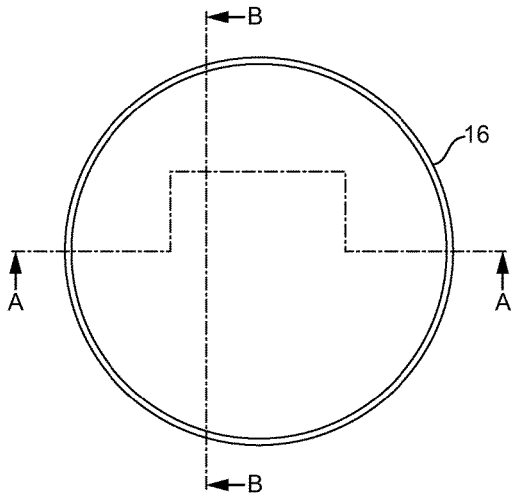
FIG. 9(*a*) illustrates the paths of two sectional views through the base when the fan assembly is in an untilted position.
Figure 9C:
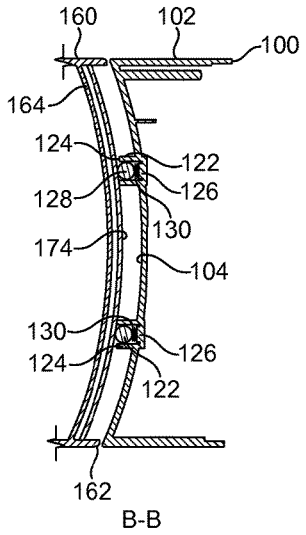
Figure 9B:
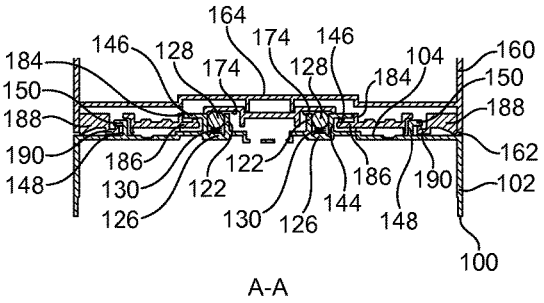

The intermediary base member 40 further comprises four support members 120 for supporting the upper base member 42 on the intermediary base member 40. The support members 120 project upwardly from the upper surface 104 of the intermediary base member 40, and are arranged such that they are substantially equidistant from each other, and substantially equidistant from the centre of the upper surface 104. A first pair of the support members 120 is located along the line B-B indicated in FIG. 9(*a*), and a second pair of the support members 120 is parallel with the first pair of support members 120. With reference also to FIGS. 9(*b*) and 9(*c*), each support member 120 comprises a cylindrical outer wall 122, an open upper end 124 and a closed lower end 126. The outer wall 122 of the support member 120 surrounds a rolling element 128 in the form of a ball bearing. The rolling element 128 preferably has a radius which is slightly smaller than the radius of the cylindrical outer wall 122 so that the rolling element 128 is retained by and moveable within the support member 120. The rolling element 128 is urged away from the upper surface 104 of the intermediary base member 40 by a resilient element 130 located between the closed lower end 126 of the support member 120 and the rolling element 128 so that part of the rolling element 128 protrudes beyond the open upper end 124 of the support member 120. In this embodiment, the resilient member 130 is in the form of a coiled spring.

Figure 10A:
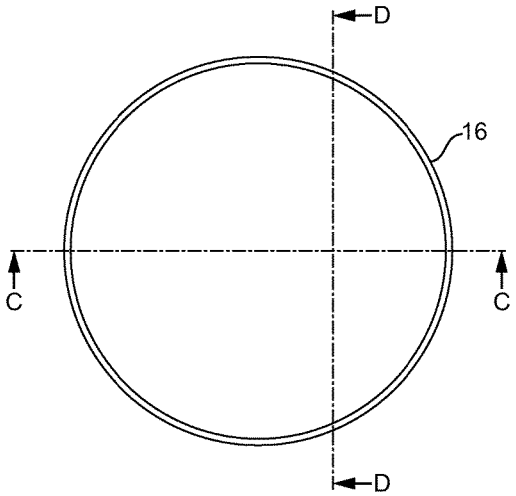
FIG. 10(*a*) illustrates the paths of two further sectional views through the base when the fan assembly is in an untilted position.
Figure 10C:
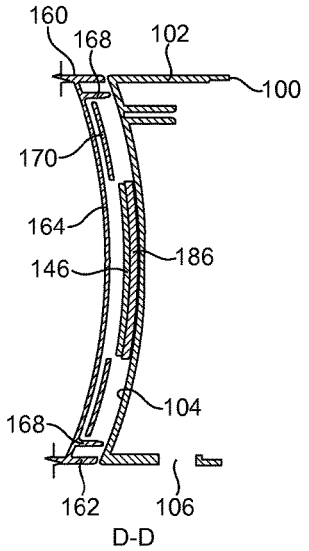
Figure 10B:
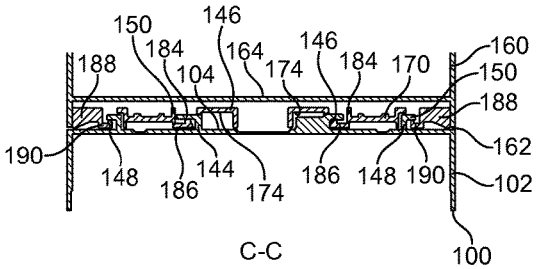

Returning to FIG. 6, the intermediary base member 40 also comprises a plurality of rails for retaining the upper base member 42 on the intermediary base member 40. The rails also serve to guide the movement of the upper base member 42 relative to the intermediary base member 40 so that there is substantially no twisting or rotation of the upper base member 42 relative to the intermediary base member 40 as it is moved from or to a tilted position. Each of the rails extends in a direction substantially parallel to the axis X. For example, one of the rails lies along line D-D indicated in FIG. 10(*a*). In this embodiment, the plurality of rails comprises a pair of relatively long, inner rails 140 located between a pair of relatively short, outer rails 142. With reference also to FIGS. 9(*b*) and 10(*b*), each of the inner rails 140 has a cross-section in the form of an inverted L-shape, and comprises a wall 144 which extends between a respective pair of the support members 120, and which is connected to, and upstanding from, the upper surface 104 of the intermediary base member 40. Each of the inner rails 140 further comprises a curved flange 146 which extends along the length of the wall 144, and which protrudes orthogonally from the top of the wall 144 towards the adjacent outer guide rail 142. Each of the outer rails 142 also has a cross-section in the form of an inverted L-shape, and comprises a wall 148 which is connected to, and upstanding from, the upper surface 52 of the intermediary base member 40 and a curved flange 150 which extends along the length of the wall 148, and which protrudes orthogonally from the top of the wall 148 away from the adjacent inner guide rail 140.

Figure 7:
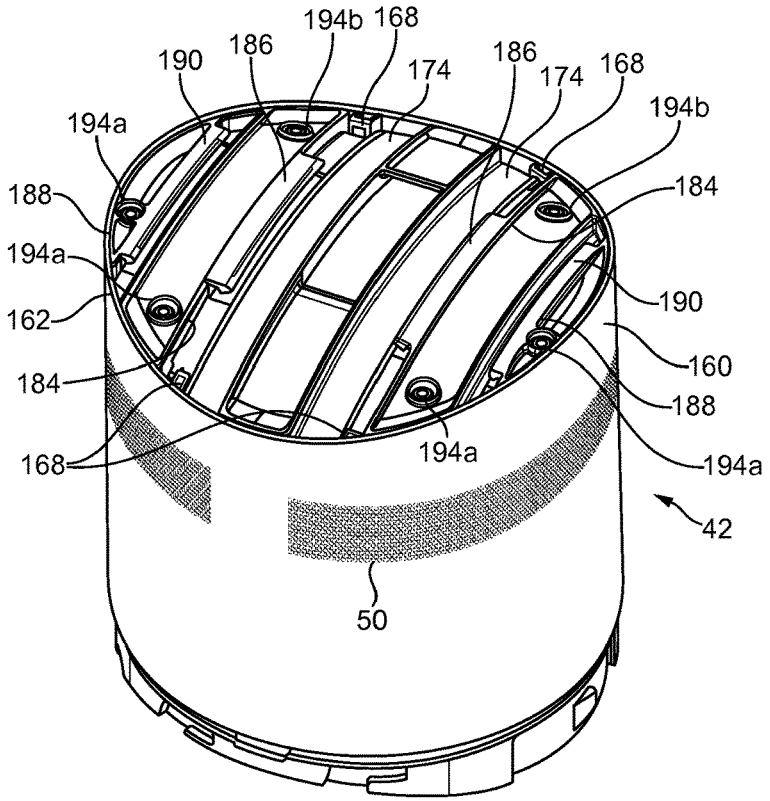
FIG. 7 is a rear perspective view of the main body of the fan assembly of FIG. 1.
Figure 8:
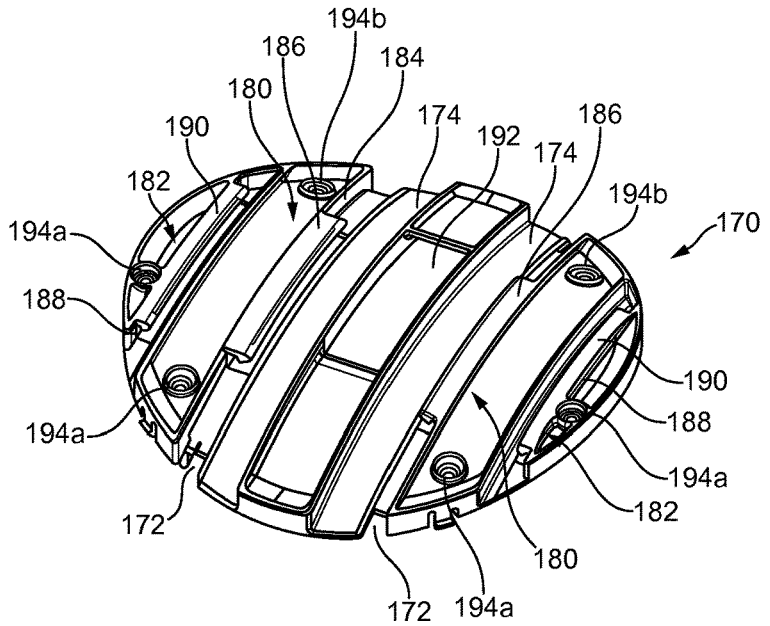
FIG. 8 is an exploded view of the main body of FIG. 7.
Figure 8:
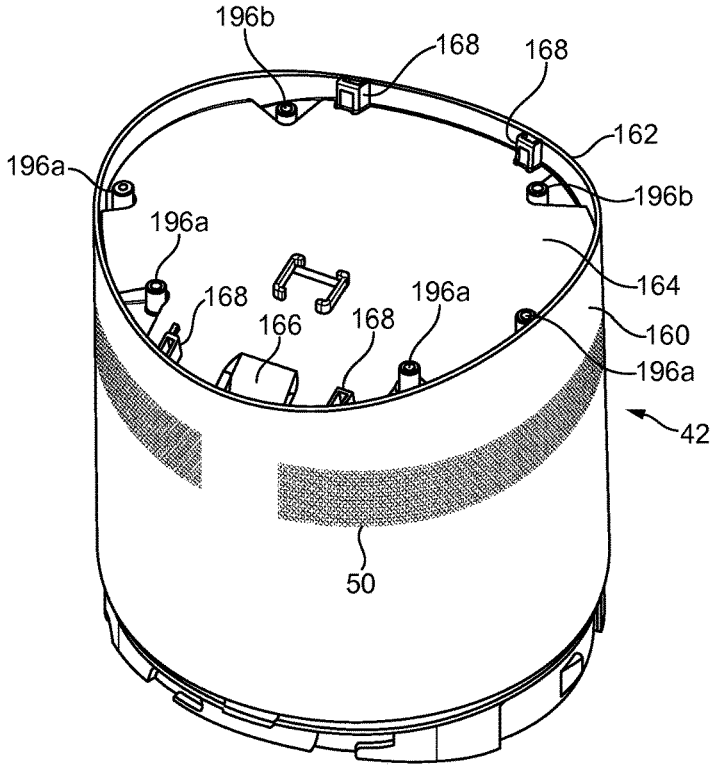

With reference now to FIGS. 7 and 8, the upper base member 42 comprises a substantially cylindrical side wall 160, an annular lower end 162 and a curved base 164 which is spaced from lower end 162 of the upper base member 42 to define a recess. The grille mesh 50 is preferably integral with the side wall 160. The side wall 160 of the upper base member 42 has substantially the same external diameter as the side wall 102 of the intermediary base member 40. The base 164 is convex in shape, and may be described generally as having an inverted saddle-shape. An aperture 166 is formed in the base 164 for allowing the cable 110 to extend from base 164 of the upper base member 42 into the cuff 114. Two pairs of stop members 168 extend upwardly (as illustrated in FIG. 8) from the periphery of base 164. Each pair of stop members 168 is located along a line extending in a direction substantially parallel to the axis X. For example, one of the pairs of stop members 168 is located along line D-D illustrated in FIG. 10(*a*).

A convex tilt plate 170 is connected to the base 164 of the upper base member 42. The tilt plate 170 is located within the recess of the upper base member 42, and has a curvature which is substantially the same as that of the base 164 of the upper base member 42. Each of the stop members 168 protrudes through a respective one of a plurality of apertures 172 located about the periphery of the tilt plate 170. The tilt plate 170 is shaped to define a pair of convex races 174 for engaging the rolling elements 128 of the intermediary base member 40. Each race 174 extends in a direction substantially parallel to the axis X, and is arranged to receive the rolling elements 128 of a respective pair of the support members 120, as illustrated in FIG. 9(*c*).

The tilt plate 170 also comprises a plurality of runners, each of which is arranged to be located at least partially beneath a respective rail of the intermediary base member 40 and thus co-operate with that rail to retain the upper base member 42 on the intermediary base member 40 and to guide the movement of the upper base member 42 relative to the intermediary base member 40. Thus, each of the runners extends in a direction substantially parallel to the axis X. For example, one of the runners lies along line D-D indicated in FIG. 10(*a*). In this embodiment, the plurality of runners comprises a pair of relatively long, inner runners 180 located between a pair of relatively short, outer runners 182. With reference also to FIGS. 9(*b*) and 10(*b*), each of the inner runners 180 has a cross-section in the form of an inverted L-shape, and comprises a substantially vertical wall 184 and a curved flange 186 which protrudes orthogonally and inwardly from part of the top of the wall 184. The curvature of the curved flange 186 of each inner runner 180 is substantially the same as the curvature of the curved flange 146 of each inner rail 140. Each of the outer runners 182 also has a cross-section in the form of an inverted L-shape, and comprises a substantially vertical wall 188 and a curved flange 190 which extends along the length of the wall 188, and which protrudes orthogonally and inwardly from the top of the wall 188. Again, the curvature of the curved flange 190 of each outer runner 182 is substantially the same as the curvature of the curved flange 150 of each outer rail 142. The tilt plate 170 further comprises an aperture 192 for receiving the electrical cable 110.

To connect the upper base member 42 to the intermediary base member 40, the tilt plate 170 is inverted from the orientation illustrated in FIGS. 7 and 8, and the races 174 of the tilt plate 170 located directly behind and in line with the support members 120 of the intermediary base member 40. The electrical cable 110 extending through the aperture 166 of the upper base member 42 may be threaded through the apertures 108, 192 in the tilt plate 170 and the intermediary base member 40 respectively for subsequent connection to the controller 44, as illustrated in FIG. 3. The tilt plate 170 is then slid over the intermediary base member 40 so that the rolling elements 128 engage the races 174, as illustrated in FIGS. 9(*b*) and 9(*c*), the curved flange 190 of each outer runner 182 is located beneath the curved flange 150 of a respective outer rail 142, as illustrated in FIGS. 9(*b*) and 10(*b*), and the curved flange 186 of each inner runner 180 is located beneath the curved flange 146 of a respective inner rail 140, as illustrated in FIGS. 9(*b*), 10(*b*) and 10(*c*).

With the tilt plate 170 positioned centrally on the intermediary base member 40, the upper base member 42 is lowered on to the tilt plate 170 so that the stop members 168 are located within the apertures 172 of the tilt plate 170, and the tilt plate 170 is housed within the recess of the upper base member 42. The intermediary base member 40 and the upper base member 42 are then inverted, and the base member 40 displaced along the direction of the axis X to reveal a first plurality of apertures 194*a* located on the tilt plate 170. Each of these apertures 194*a* is aligned with a tubular protrusion 196*a* on the base 164 of the upper base member 42. A self-tapping screw is screwed into each of the apertures 194*a* to enter the underlying protrusion 196*a*, thereby partially connecting the tilt plate 170 to the upper base member 42. The intermediary base member 40 is then displaced in the reverse direction to reveal a second plurality of apertures 194*b* located on the tilt plate 170. Each of these apertures 194*b* is also aligned with a tubular protrusion 196*b* on the base 164 of the upper base member 42. A self-tapping screw is screwed into each of the apertures 194*b* to enter the underlying protrusion 196*b* to complete the connection of the tilt plate 170 to the upper base member 42.

When the upper base member 42 is attached to the intermediary base member 40 and the bottom surface 43 of the lower base member 38 positioned on a support surface, the upper base member 42 is supported by the rolling elements 128 of the support members 120. The resilient elements 130 of the support members 120 urge the rolling elements 128 away from the closed lower ends 126 of the support members 120 by a distance which is sufficient to inhibit scraping of the upper surfaces of the intermediary base member 40 when the upper base member 42 is tilted. For example, as illustrated in each of FIGS. 9(*b*), 9(*c*), 10(*b*) and 10(*c*) the lower end 162 of the upper base member 42 is urged away from the upper surface 104 of the intermediary base member 40 to prevent contact therebetween when the upper base member 42 is tilted. Furthermore, the action of the resilient elements 130 urges the concave upper surfaces of the curved flanges 186, 190 of the runners against the convex lower surfaces of the curved flanges 146, 150 of the rails.

To tilt the upper base member 42 relative to the intermediary base member 40, the user slides the upper base member 42 in a direction parallel to the axis X to move the upper base member 42 towards one of the fully tilted positions illustrated in FIGS. 5(*b*) and 5(*c*), causing the rolling elements 128 move along the races 174. Once the upper base member 42 is in the desired position, the user releases the upper base member 42, which is retained in the desired position by frictional forces generated through the contact between the concave upper surfaces of the curved flanges 186, 190 of the runners and the convex lower surfaces of the curved flanges 146, 150 of the rails acting to resist the movement under gravity of the upper base member 42 towards the untilted position illustrated in FIG. 5(*a*). The fully titled positions of the upper base member 42 are defined by the abutment of one of each pair of stop members 168 with a respective inner rail 140.

Referring to FIGS. 2(*b*) and 2(*c*), to connect the nozzle 14 to the base 12, the nozzle 14 is inverted from the orientation illustrated in FIG. 2(*c*) and the lugs 132 of the base 92 of the outer casing section 80 located directly in line with the open upper end of the open grooves 161 of the upper end of the upper base member 42. In this position the pair of ramps 134 of the base 92 is directly in line with the pair of wedge members 165 of the upper end of the upper base member 42, and the tapered surface of each wedge member 165 abuts an upper surface of a corresponding ramp 134. The lugs 132 are accommodated within the open grooves 161 and the base 92 is mounted over the upper end of the upper base member 42. The lugs 132 are caused to engage with and move along the track 163 by rotation of the nozzle 14 relative to the base 12. The rotation also causes the ramp 134 to run up and slide over the taper 167 of the wedge member 165. With continued rotation of the nozzle relative to the base, the ramp 134 is forced over the side wall 169 of the wedge member 165. The ramp 134 is subsequently retained by the side wall 169. In this way the nozzle 14 is brought into engagement with the base 12. The rotation does not require excessive rotational force and the assembly may be carried out by a user.

Once engaged, the nozzle 14 is prevented from disengagement from the base 12 by the location of the ramp 134 beyond the side wall 169 of the wedge portion 165. In a bayonet style fixing, as described here, a significantly greater force will be required to disengage the ramp 134 and the wedge portion 165 than is required for engagement.

To detach the nozzle 14 from the base 12, for example for maintenance or for changing the nozzle 14 to an alternative nozzle 14, the nozzle 14 is rotated relative the base 12 in the opposite direction to that for engagement of the nozzle 14 with the base 12. In the illustrated embodiment the nozzle 14 is rotated in a clockwise direction relative to the base 12 in order to connect the nozzle to the base 12, and the nozzle 14 is rotated in an anticlockwise direction relative to the base 12 to detach the nozzle 14 from the base 12. With a suitable rotational force in an anticlockwise direction the side wall 65 of the upper end of the upper base member 42 is caused to flex inwardly, whereas the inner surface 93 of the base 92 of the outer casing section 80 is caused to flex outwardly. The flexion causes the ramp 134 and the wedge member 165 to move away from each other radially, with the result that the ramp 134 is displaced outwardly away from the side wall 169 of the wedge member 165 so that the ramp 134 can be slid along the taper 167 with rotation of the nozzle 14 relative to the base 12. Although the detachment of the nozzle 14 from the base 12 requires a greater force than the force required for engagement, the force required may be suitable for exertion by a user of the fan assembly, or may be suitable for effecting in manufacture only. The side wall 65 of the upper end of the upper base member 42 can have resilience suitable for movement by a user or by an assembly operation.

To operate the fan assembly 10 the user depresses an appropriate one of the buttons 20 on the base 12, in response to which the controller 44 activates the motor 56 to rotate the impeller 52. The rotation of the impeller 52 causes a primary air flow to be drawn into the base 12 through the air inlets 18. Depending on the speed of the motor 56, the primary air flow may be between 20 and 30 liters per second. The primary air flow passes sequentially through the impeller housing 64, the upper end of the upper base member 42 and open upper end of the motor bucket retainer 63 to enter the interior passage 86 of the nozzle 14. The primary air flow emitted from the air outlet 71 is in a forward and upward direction. Within the nozzle 14, the primary air flow is divided into two air streams which pass in opposite directions around the central opening 24 of the nozzle 14. Part of the primary airflow entering the nozzle 14 in a sideways direction passes into the interior passage 86 in a sideways direction without significant guidance, another part of the primary airflow entering the nozzle 14 in a direction parallel to the X axis is guided by the curved vane 65*a*, 65*b* of the motor bucket retainer 63 to enable the air flow to pass into the interior passage 86 in a sideways direction. The vane 65*a*, 65*b* enables air flow to be directed away from a direction parallel to the X axis. As the air streams pass through the interior passage 86, air enters the mouth 26 of the nozzle 14. The air flow into the mouth 26 is preferably substantially even about the opening 24 of the nozzle 14. Within each section of the mouth 26, the flow direction of the portion of the air stream is substantially reversed. The portion of the air stream is constricted by the tapering section of the mouth 26 and emitted through the outlet 98.

The primary air flow emitted from the mouth 26 is directed over the Coanda surface 28 of the nozzle 14, causing a secondary air flow to be generated by the entrainment of air from the external environment, specifically from the region around the outlet 98 of the mouth 26 and from around the rear of the nozzle 14. This secondary air flow passes through the central opening 24 of the nozzle 14, where it combines with the primary air flow to produce a total air flow, or air current, projected forward from the nozzle 14. Depending on the speed of the motor 56, the mass flow rate of the air current projected forward from the fan assembly 10 may be up to 400 liters per second, preferably up to 600 liters per second, and the maximum speed of the air current may be in the range from 2.5 to 4 m/s.

The even distribution of the primary air flow along the mouth 26 of the nozzle 14 ensures that the air flow passes evenly over the diffuser surface 30. The diffuser surface 30 causes the mean speed of the air flow to be reduced by moving the air flow through a region of controlled expansion. The relatively shallow angle of the diffuser surface 30 to the central axis X of the opening 24 allows the expansion of the air flow to occur gradually. A harsh or rapid divergence would otherwise cause the air flow to become disrupted, generating vortices in the expansion region. Such vortices can lead to an increase in turbulence and associated noise in the air flow which can be undesirable, particularly in a domestic product such as a fan. The air flow projected forwards beyond the diffuser surface 30 can tend to continue to diverge. The presence of the guide surface 32 extending substantially parallel to the central axis X of the opening 30 further converges the air flow. As a result, the air flow can travel efficiently out from the nozzle 14, enabling the air flow can be experienced rapidly at a distance of several meters from the fan assembly 10.

The invention is not limited to the detailed description given above. Variations will be apparent to the person skilled in the art.

Detachment of the nozzle may be achieved through rotation of the base relative to the nozzle or with rotation of a portion of the base. Alternative connection means for example by a snap-fit and release connections could be used. Other variations and components within the base may be used, for example, the silencing member and silencing components such as silencing or acoustic foam may be formed in any shape or have any suitable construction. For example the density and type of foam may be altered. The motor bucket retainer and the sealing member may have a different size and/or shape to that described above and may be located in a different position within the fan assembly. The technique of creating an air tight seal with the sealing member may be different and may include additional elements such as glue or fixings. The sealing member, the guide portion, the vanes and the motor bucket retainer may be formed from any material with suitable strength and flexibility or rigidity, for example foam, plastics, metal or rubber. The movement of the upper base member 42 relative to the base may be motorised, and actuated by user through depression of one of the buttons 20.

The invention claimed is:

1. A bladeless fan assembly for creating an air current, the bladeless fan assembly comprising a nozzle mounted on a base, the nozzle comprising an interior passage and a mouth for receiving an air flow from the interior passage and through which the air flow is emitted from the fan assembly, the nozzle defining an opening through which air from outside the bladeless fan assembly is drawn by the air flow emitted from the mouth, wherein the nozzle is detachable from the base, and wherein the base comprises an impeller for generating the air flow, a motor located within a motor housing, and a retainer for inhibiting removal of the motor from the base when the nozzle is detached from the base, and wherein the retainer for inhibiting removal of the motor from the base is within the base and connected to an open upper end of the base and is connected to the motor housing to allow movement of the motor housing relative to the base.

2. The fan assembly of claim 1, wherein the nozzle is detachable from the base through rotation of the nozzle relative to the base.

3. The fan assembly of claim 1, wherein the nozzle comprises a detent for releasably engaging a portion of the base to inhibit rotation of the nozzle relative to the base.

4. The fan assembly of claim 3, wherein said portion of the base comprises a wedge.

5. The fan assembly of claim 3, wherein the detent is arranged to flex out of engagement with said portion of the base to detach the nozzle from the base.

6. The fan assembly of claim 3, wherein the nozzle comprises a second detent for releasably engaging a portion of the base to inhibit movement of the nozzle away from the base.

7. The fan assembly of claim 1, wherein the opening is sized so that when the nozzle is detached from the base, the base can be stored within the opening.

8. The fan assembly of claim 1, wherein the nozzle has a height extending from the end of the nozzle remote from the base to the end of the nozzle adjacent the base, and the base has a height extending from the end of the base remote from the nozzle to the end of the base adjacent the nozzle, the height of the base being no more than 75% of the height of the nozzle.

9. The fan assembly of claim 8, wherein the height of the base is in the range from 65% to 55% of the height of the nozzle.

10. The fan assembly of claim 1, wherein the height of the fan assembly is in the range 300 mm to 400 mm.

11. The fan assembly of claim 1, wherein the base is substantially cylindrical.

12. The fan assembly of claim 1, wherein the mouth is located towards the rear of the nozzle.

13. The fan assembly of claim 1, wherein the nozzle comprises a surface located adjacent the mouth and over which the mouth is arranged to direct the air flow.

14. The fan assembly of claim 13, wherein the nozzle comprises a diffuser located downstream of said surface.

15. The fan assembly of claim 1, wherein the nozzle comprises an annular inner casing section and an annular outer casing section which together define the interior passage and the mouth.

16. The fan assembly of claim 15, wherein the mouth comprises an outlet located between an external surface of the inner casing section and an internal surface of the outer casing section.

17. The fan assembly of claim 16, wherein the outlet is in the form of a slot.

* * * * *